US009056493B2

(12) United States Patent
Kobayashi et al.

(10) Patent No.: US 9,056,493 B2
(45) Date of Patent: Jun. 16, 2015

(54) IMAGE FORMING APPARATUS WHICH PERFORMS A CLEANING OPERATION TO REMOVE A FILM DEPOSITED IN A MOTOR

(71) Applicant: Konica Minolta, Inc., Chiyoda-ku (JP)

(72) Inventors: Yuji Kobayashi, Toyohashi (JP); Takaki Kato, Toyokawa (JP); Yuta Tachibana, Toyokawa (JP); Hiroshi Yamaguchi, Toyokawa (JP); Satoshi Teshima, Okazaki (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 120 days.

(21) Appl. No.: 13/865,860

(22) Filed: Apr. 18, 2013

(65) Prior Publication Data

US 2013/0279960 A1 Oct. 24, 2013

(30) Foreign Application Priority Data

Apr. 20, 2012 (JP) ..... 2012-096690

(51) Int. Cl.

*G03G 15/00* (2006.01)
*B41J 13/00* (2006.01)
*B65H 5/06* (2006.01)
(Continued)

(52) U.S. Cl.

CPC ..... *B41J 13/0009* (2013.01); *G03G 15/6529* (2013.01); *B41J 13/0018* (2013.01); *G03G 15/6555* (2013.01); *B65H 5/062* (2013.01); *B41J 29/17* (2013.01); *B41J 29/38* (2013.01)

(58) Field of Classification Search

CPC .... B41J 13/0009; B41J 13/0018; B41J 29/17; B41J 29/38; G03G 15/602; G03G 15/6529; G03G 15/6555; G03G 21/00; B65H 5/06; B65H 5/062; B65H 2555/20

See application file for complete search history.

(56) References Cited

U.S. PATENT DOCUMENTS

2003/0155172 A1 * 8/2003 Kawada et al. ..... 180/446
2004/0057740 A1 3/2004 Inukai
2004/0165915 A1 8/2004 Hirai et al.
(Continued)

FOREIGN PATENT DOCUMENTS

CN 1470960 1/2004
CN 1624601 6/2005
(Continued)

OTHER PUBLICATIONS

Office Action issued in corresponding Chinese Patent Application No. 201310138457.4; dated Feb. 17, 2015, and English translation thereof (13 pages).

*Primary Examiner* — Blake A Tankersley
(74) *Attorney, Agent, or Firm* — Buchanan Ingersoll & Rooney PC

(57) ABSTRACT

An image forming apparatus includes: a conveyance roller configured to convey recording sheets; a brush motor configured to drive the conveyance roller to rotate; and a control unit configured to control a rotational speed of the brush motor, wherein while the conveyance roller conveys a recording sheet, (i) the control unit applies voltage to an outer circumferential surface of a commutator of the brush motor to drive the brush motor to rotate by a predetermined rotation amount, so as to perform a cleaning operation to remove a film deposited on the outer circumferential surface, and (ii) the control unit reduces the rotational speed of the brush motor while not performing the cleaning operation, so as to correct a conveyance distance of the recording sheet.

9 Claims, 18 Drawing Sheets

(51) Int. Cl.
*B41J 29/17* (2006.01)
*B41J 29/38* (2006.01)

(56) References Cited

U.S. PATENT DOCUMENTS

| | | | |
|---|---|---|---|
| 2005/0117932 | A1 | 6/2005 | Takiguchi et al. |
| 2007/0206970 | A1 | 9/2007 | Izumi et al. |
| 2009/0052921 | A1 | 2/2009 | Nishiwaki |

FOREIGN PATENT DOCUMENTS

| | | | | |
|---|---|---|---|---|
| CN | 101030063 | | 9/2007 | |
| CN | 101373353 | | 2/2009 | |
| JP | 59-136094 | A | 8/1984 | |
| JP | 04325890 | * | 11/1992 | ..... H02P 5/06 |
| JP | 2003-302816 | | 10/2003 | |
| JP | 2005-055653 | | 3/2005 | |
| JP | 2011-018392 | | 1/2011 | |
| JP | 2011-018392 | A | 1/2011 | |

* cited by examiner (1) Drive circuit (2) Pulse waveform (a)

Normal rotation: Low-speed driven (PWM = Low)

Hi = Motor driven (b)

Normal rotation: High-speed driven (PWM = High)

(c)

Reverse rotation: High-speed driven (PWM = High)

IMAGE FORMING APPARATUS WHICH PERFORMS A CLEANING OPERATION TO REMOVE A FILM DEPOSITED IN A MOTOR

This application is based on an application No. 2012-096690 filed in Japan, the contents of which are hereby incorporated by reference.

BACKGROUND OF THE INVENTION (1) Field of the Invention

The present invention relates to an image forming apparatus, and particularly to an art of removing a graphite insulation film (hereinafter, carbon film) deposited on the outer circumferential surface of a commutator of a brush motor that drives a conveyance roller that conveys recording sheets.

(2) Description of the Related Art

An image forming apparatus includes a conveyance roller that conveys recording sheets each on which toner images are to be carried. The conveyance roller is driven to rotate by a brush motor, for example. The brush motor has the structure in which a brush is in contact with a commutator rotating together with a rotor such that an electrical power is fed from the brush to the commutator.

There is known that the use of a brush motor for a long period causes formation of a carbon film on a surface of a commutators due to spark discharge between a brush and the commutator. The carbon film needs to be removed so as to avoid the carbon film from hindering the electrical power feed from the brush to the commutator.

For this reason, with respect to a brush motor included in a disc playback device that moves an optical pickup, there has been proposed a conventional art of removing a carbon film deposited on the brush motor by applying a high voltage of 24 V or more for example to the deposited a carbon film to cause insulation breakdown of the carbon film (see Japanese Patent Application Publication No. 2011-18392).

According to this conventional art, a worm gear is attached to a rotor of the brush motor. There occurs a positional deviation between a brush and a commutator in the thrust direction (the axial direction of the worm gear), depending on the rotational direction of the rotor. Accordingly, a cleaning sequence is performed both while the rotor makes positive rotation and while the rotor makes reverse rotation.

When a high voltage is applied to the commutator from the brush so as to remove the carbon film, the rotational speed of the rotor increases. For this reason, according to the above conventional art, a cleaning sequence cannot be performed while audio playback operations are performed by positive rotation of the rotor. Accordingly the cleaning sequence is performed while audio playback operations are not performed. For example, in order to repeatedly play back music which has ended once, the brush motor drives the rotor to make reverse rotation so as to move the optical pickup to the start position of the track by. Application of a high voltage in this situation enables performance of a cleaning sequence by reverse rotation of the rotor.

However, in order to perform a cleaning sequence by positive rotation in the same manner as in the above reverse rotation, the brush motor needs to move the optical pickup in the direction opposite to the start position of the track. This causes a problem that the start of repeat playback is delayed.

Therefore, there is a possibility that if the above conventional art is applied to an image forming apparatus that includes a brush motor that drives a conveyance roller to rotate, the conveyance speed of recording sheets reduces, and this results in reduction in productivity of the image forming apparatus.

SUMMARY OF THE INVENTION

The present invention was made in view of the above problem, and aims to provide an image forming apparatus capable of cleaning brush a motor that drives a conveyance roller to rotate with no reduction in productivity.

In order to achieve the above aim, the image forming apparatus relating to the present invention is an image forming apparatus comprising: a conveyance roller configured to convey recording sheets; a brush motor configured to drive the conveyance roller to rotate; and a control unit configured to control a rotational speed of the brush motor, wherein while the conveyance roller conveys a recording sheet, (i) the control unit applies voltage to an outer circumferential surface of a commutator of the brush motor to drive the brush motor to rotate by a predetermined rotation amount, so as to perform a cleaning operation to remove a film deposited on the outer circumferential surface, and (ii) the control unit reduces the rotational speed of the brush motor while not performing the cleaning operation, so as to correct a conveyance distance of the recording sheet.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings.

DESCRIPTION OF THE PREFERRED EMBODIMENTS

The following describes an embodiment of an image forming apparatus relating to the present invention, with reference to the drawings.

[1] Structure of Image Forming Apparatus

Firstly, description is given on the structure of the image forming apparatus relating to the present embodiment.

The image forming apparatus relating to the present embodiment is so-called a printer apparatus, and forms images in response to a print instruction including print data from other device. Also, the image forming apparatus relating to the present embodiment forms images on both plain papers and heavy papers including coated papers.

Figure 1:
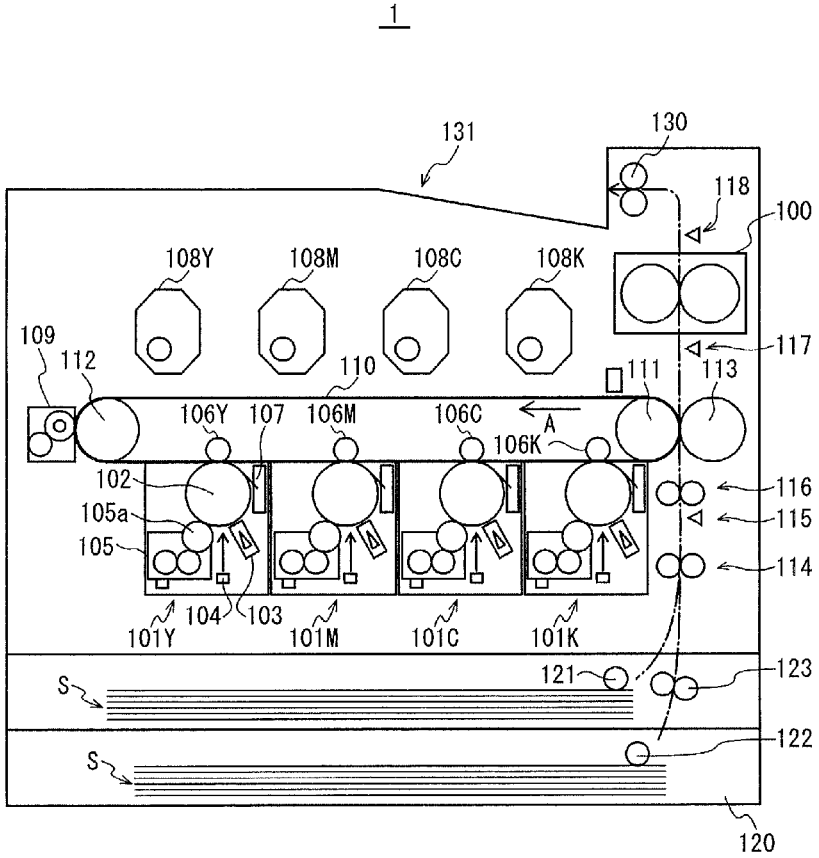
FIG. 1 shows the structure of main elements of an image forming apparatus 1 relating to an embodiment of the present invention.

FIG. 1 shows the structure of main elements of the image forming apparatus relating to the present embodiment. An image forming apparatus 1 is a color image forming apparatus employing so-called an intermediate transfer system, and includes image forming units 101Y to 101K as shown in FIG. 1. The image forming units 101Y to 101K having the same structure as shown below. A charger 103 uniformly charges the outer circumferential surface of a cylindrical photosensitive drum 102 such that the outer circumferential surface has a predetermined potential. Then, an exposure 104 performs image exposure on a charged region in accordance with an original document, and as a result an electrostatic latent image is formed.

A developer 105 supplies each of respective toners of YMCK colors supplied from toner cartridges 108Y to 108K on the outer circumferential surface of the photosensitive drum 102 by a developing roller 105*a* to which a developing bias is applied, so as to develop an electrostatic latent image to form a visible toner image. Each of primary transfer rollers 106Y to 106K to which a primary transfer voltage is applied electrostatically absorbs toners, so as to primary transfer the visible toner image from the outer circumferential surface of the photosensitive drum 102 onto an intermediate transfer belt 110.

The respective toner images of the YMCK colors are superimposed on top of one another on the intermediate transfer belt 110. As a result, a full-color toner image is formed. Also, after the visible toner image is primary transferred onto the intermediate transfer belt 110, toners remaining on the outer circumferential surface of the photosensitive drum 102 are removed by a cleaner 107.

The intermediate transfer belt 110 stretches and lays on a driving roller 111 which corresponds in position to a secondary transfer roller 113, and a driven roller 112. While the intermediate transfer belt 110 is driven by the driving roller 111, which is driven by a main motor, to rotate in the direction indicated by an arrow A in FIG. 1, the respective toner images of the YMCK colors are primary transferred onto the intermediate transfer belt 110. The driven roller 112 is driven to rotate by a force of friction with the intermediate transfer belt 110 during rotation.

While the above operations are performed, one of pickup rollers 121 and 122 picks up and sends out recording sheets S housed in a paper feed cassette 120 piece by piece, and the recording sheets S, which have been sent out by the pickup roller 122, are further conveyed by a pair of conveyance rollers 123. Note that although FIG. 1 exemplifies the structure in which the paper feed cassette 120 houses therein two types of recording sheets S, the paper feed cassette 120 may be capable of housing therein three types or more of recording sheets S.

The recording sheets S, which have been conveyed from the paper feed cassette 120, are conveyed through a pair of conveyance rollers 114 and a pair of timing rollers 116, and are further conveyed to a secondary transfer nip resulting from pressure-contact between the driving roller 111 and the secondary transfer roller 113. A secondary transfer bias is applied to the secondary transfer roller 113. In the secondary transfer nip, toner images carried on the intermediate transfer belt 110 are electrostatically transferred onto each of the recording sheets S.

The pair of timing rollers 116 adjusts a timing of conveying each of the recording sheets S by turning a timing clutch (not illustrated) between ON and OFF, such that the toner images carried on the intermediate transfer belt 110 are transferred onto a desired position on the recording sheet S. Also, a pre-timing sensor 115 is provided on a conveyance path of recording sheets S from the pickup roller 121 to the pair of timing rollers 116, and detects passing of the recording sheet S.

A fixing loop sensor 117 detects passing of the recording sheet S on which the toner images are carried. Then, the recording sheet S is conveyed to a fixing device 100 employing the resistance heating element, and the toner images are thermally fixed onto the recording sheet S. Then, a paper ejection sensor 118 detects ejection of the recording sheet S from the fixing device 100. The recording sheet S is ejected onto an ejection tray 131 through a paper ejection roller 130. Also, toners remaining on the intermediate transfer belt 110 after the secondary transfer are conveyed in the direction indicated by the arrow A, and then the remaining toners are removed by the cleaner 109.

Generally, heavy papers are higher in heat capacity than plain papers. Accordingly, it takes a longer time to thermally fix toner images onto heavy papers than onto plain papers. Accordingly, in the case where heavy papers are used, image formation is performed at a reduced system speed (by the smaller number of sheets for image formation per time unit) compared with the case where plain papers are used. Also, the image forming apparatus 1 includes a communication device which is not illustrated, and receives a print instruction from other apparatus via a communication network.

[2] Structure of Conveyance System

The following describes the structure of, among elements of the conveyance system for conveying recording sheets S from the paper feed cassette 120 to the paper ejection tray 131, elements from the paper feed cassette 120 to the pair of timing rollers 116.

Figure 2:
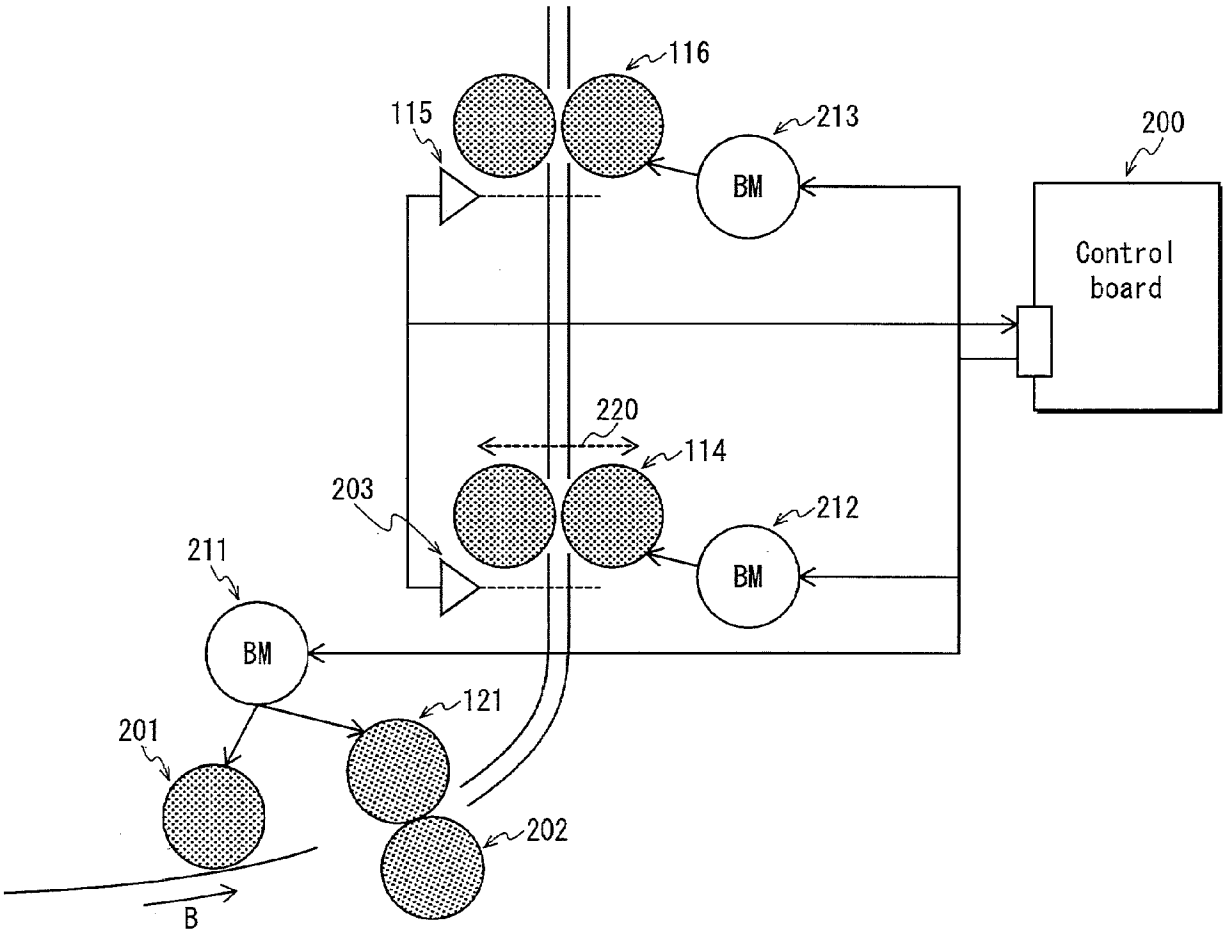
FIG. 2 is a pattern diagram showing the structure of main elements of a conveyance system included in the image forming apparatus 1.

FIG. 2 is a pattern diagram showing the structure of the conveyance system. As shown in FIG. 2, recording sheets S housed in the paper feed cassette 120 are picked up piece by piece by the pickup roller 201 in the direction indicated by an arrow B in FIG. 2. The recording sheets S are conveyed to the conveyance path by the paper feed roller 121 and a separation roller 202. The paper feed roller 121, the pickup roller 201, and the separation roller 202 are driven to rotate by a brush motor (hereinafter, paper feed motor) 211.

Then, the front edge of each of the recording sheets S is detected by a conveyance sensor 203. Then, the recording sheet S is further conveyed by the pair of conveyance rollers 114, which is driven to rotate by a brush motor (hereinafter, conveyance motor) 212. When a drive stop period elapses since the front edge of the recording sheet S is detected by the conveyance sensor 203, it is judged that the front edge of the recording sheet S reaches a drive stop position in the paper feed motor 211. Then, the paper feed motor 211 is stopped, and the rotation of the paper feed roller 121, the pickup roller 201, and the separation roller 202 is also stopped. Here, the drive stop period is a period necessary for the front edge of the recording sheet S to reach the drive stop position of the paper feed motor 211 after detected by the conveyance sensor 203.

Then, the front edge of the recording sheet S is detected by the timing sensor 115, and then strikes against the pair of timing rollers 116. The pair of timing rollers 116 is driven to rotate by a brush motor (hereinafter, timing motor) 213, and conveys the recording sheet S in accordance with a timing of secondary transfer of toner images carried on the intermediate transfer belt 110.

Note that the rotational operations of the paper feed motor 211, the conveyance motor 212, and the timing motor 213 are controlled by the control board 200. Also, detection signals of the conveyance sensor 203 and the timing sensor 115 are input to the control board 200.

[3] Structure of Control Board 200

The following describes the structure of the control board 200.

Figure 3:
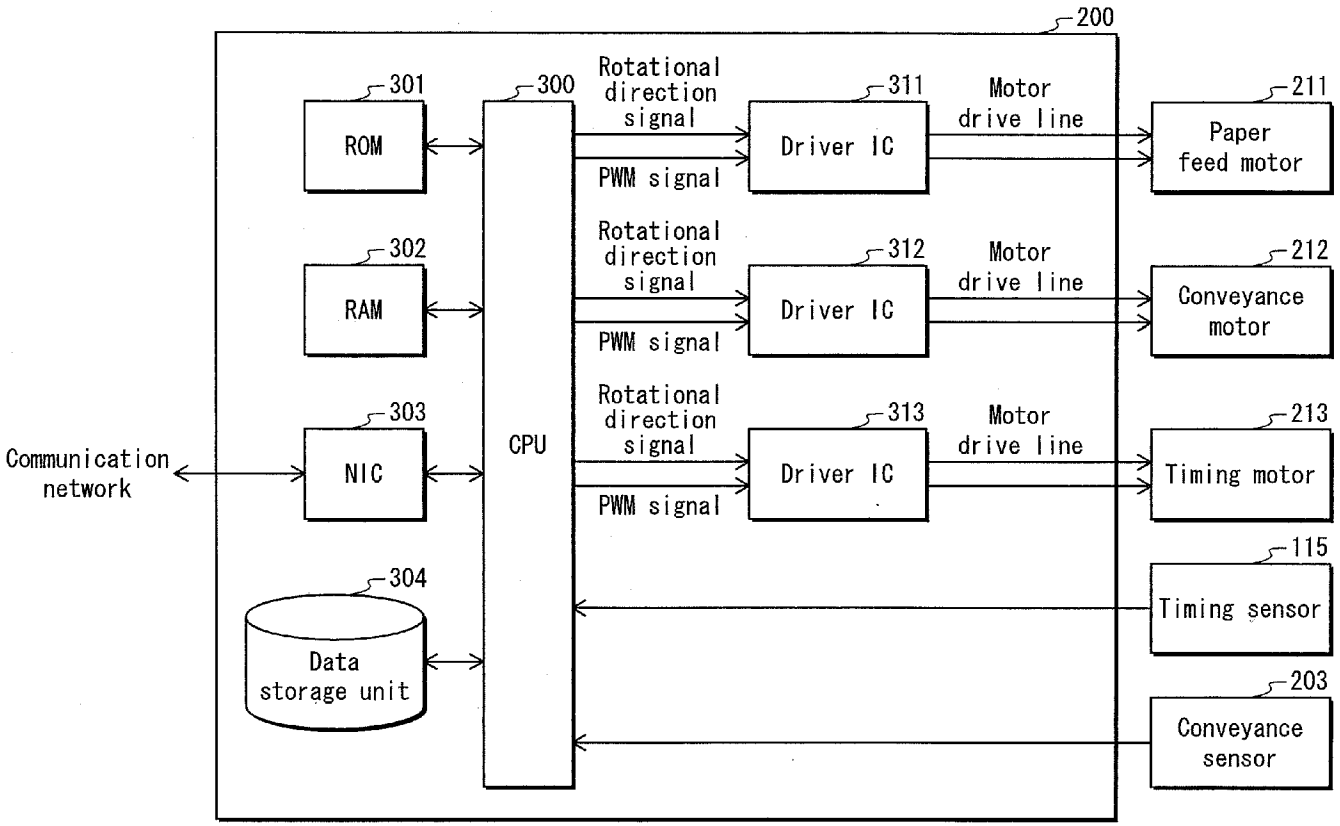
FIG. 3 is a block diagram showing the structure of main elements of a control board 200 included in the image forming apparatus 1.

FIG. 3 is a block diagram showing the structure of main elements of the control board 200. As shown in FIG. 3, the control board 200 includes a CPU (Central Processing Unit) 300. When being reset at power-on for example, the CPU 300 reads a control program from a ROM (Read Only Memory) 301, and executes the control program using a RAM (Random Access Memory) 302 as a storage region for work. The control board 200 may include a non-volatile semiconductor memory.

Also, the CPU 300 reads and records data necessary for executing the control program from and into a data storage unit (HDD: Hard Disk Drive) 304. Furthermore, the CPU 300 includes an NIC (Network Interface card) 303, and transmits and receives data to and from other device via a communication network. Through this, the CPU 300 receives a print instruction including print data from other device.

Figure 4:
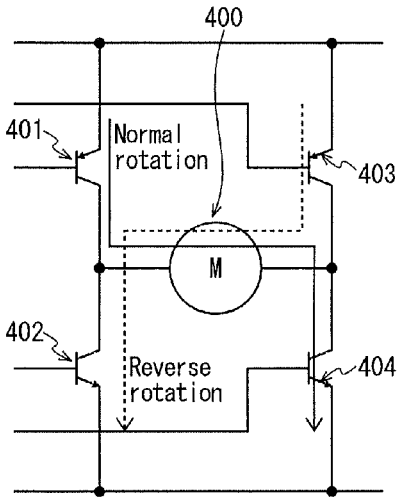
FIG. 4 shows a circuit that drives a brush motor used in the conveyance system and the waveform of PWM signals.
Figure 4:
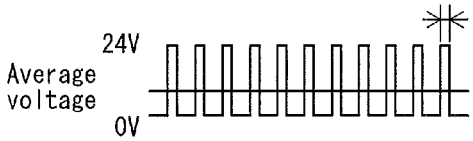
Figure 4:
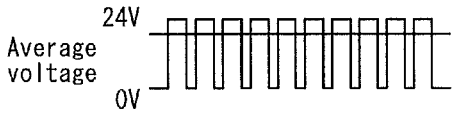
Figure 4:
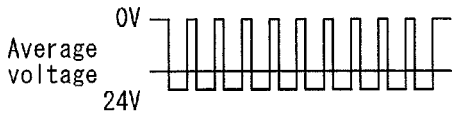

The control board 200 has mounted thereon driver ICs (Integrated Circuits) 311 to 313 that each drive a different one of the brush motors. Upon receiving input of a rotational direction signal and a PWM (Pulse Width Modulation) signal from the CPU 300, the driver ICs 311 to 313 drive the paper feed motor 211, the conveyance motor 212, and the timing motor 213, respectively. FIG. 4 shows a circuit that drives a brush motor in section (1) and the waveform of PWM signals in section (2). As shown in section (1) in FIG. 4, a drive circuit of a brush motor 400 includes four MOSFETs (Metal Oxide Semiconductor Field Effect Transistors) 401 to 404.

When the drive circuit flows a PWM signal in the direction indicated by the solid-line arrow in the figure while turning the MOSFETs 401 and 404 ON and turning the MOSFETs 402 and 403 OFF, the brush motor 400 makes positive rotation (rotation in the conveyance direction of recording sheets S in the present embodiment). Also, when the drive circuit flows a PWM signal in the direction indicated by the dashed-line arrow in the figure while turning the MOSFETs 401 and 404 OFF and turning the MOSFETs 402 and 403 ON, the brush motor 400 makes reverse rotation (rotation in a direction opposite to the direction of positive rotation).

The rotational speed of the brush motor is controlled by changing the duty ratio of a PWM signal. When the ON duty ratio (duty ratio at which a PWM signal has a voltage of 24 V in the present embodiment) is decreased while the brush motor 400 makes positive rotation, the average voltage applied to the brush motor 400 decreases. As a result, the rotational speed of the brush motor 400 decreases (section (2)(a) in FIG. 4). On the contrary, when the ON duty ratio is increased while the brush motor 400 makes positive rotation, the rotational speed of the brush motor 400 increases (section (2)(b) in FIG. 4). Note that, in the present embodiment, the PWM signal has an OFF voltage of 0 V.

Also while the brush motor 400 makes reverse rotation, the rotational speed of the brush motor 400 is controlled by changing the duty ratio of the PWM signal. Specifically, when the ON duty ratio is increased while the brush motor 400 makes reverse rotation, the rotational speed of the brush motor 400 increases. On the contrary, when the ON duty ratio is decreased while the brush motor 400 makes reverse rotation, the rotational speed of the brush motor 400 decreases (section (2)(c) in FIG. 4). In this way, the CPU 300 inputs a rotational direction signal indicating the rotational direction of the brush motor 400 to the driver ICs 311 to 313, so as to control ON and OFF of the MOSFETs 401 to 404. Also, the CPU 300 inputs PWM signals to the driver ICs 311 to 313, so as to control the average voltage applied to the brush motor 400 to control the rotational speed of the brush motor 400.

As described above, the system speed differs between the case where image formation is performed on plain papers and the case where image formation is performed on heavy papers. For this reason, the rotational speed of the brush motor 400 is controlled in accordance with the type of recording sheets S. Specifically, in the case where image formation is performed on plain papers, the CPU 300 outputs a PWM signal so as to increase the ON duty ratio and the average voltage to increase the system speed. Also, in the case where image formation is performed on heavy papers, the CPU 300 outputs a PWM signal so as to decrease the ON duty ratio and the average voltage to decrease the system speed.

[4] Control Operations by Control Board 200

The following describes the control operations performed by the control board 200, focusing particularly on control operations of removing a carbon film deposited on the outer circumferential surface of a commutator of the paper feed motor 211. Note that the control board 200 performs the similar control operations on the conveyance motor 212 and the timing motor 213 other than the paper feed motor 211, other brush motor which is not illustrated in FIG. 1 and FIG. 2, and so on.

As described above, in the case where image formation is performed on plain papers, the average voltage applied to the commutator of the brush motor 400 increases. Accordingly, immediately after a carbon film is formed on the outer circumferential surface of the commutator, the carbon film is removed by insulation breakdown and the conductivity is maintained. Compared with this, in the case where image formation is performed on heavy papers, the average voltage applied to the commutator of the brush motor 400 decreases. Accordingly, no insulation breakdown occurs, and a carbon film formed on the outer circumferential surface of the commutator remains without being removed. Especially when the rotational speed of the brush motor 400 is lower than the rated rotational speed thereof, a carbon film is likely to be formed. Note that the rated rotational speed of the brush motor is 2500 rotations to 3200 rotations per second in the present embodiment. Therefore, in the case where image formation is performed on heavy papers, the control board 200 performs a cleaning operation in the following manner.

Figure 5:
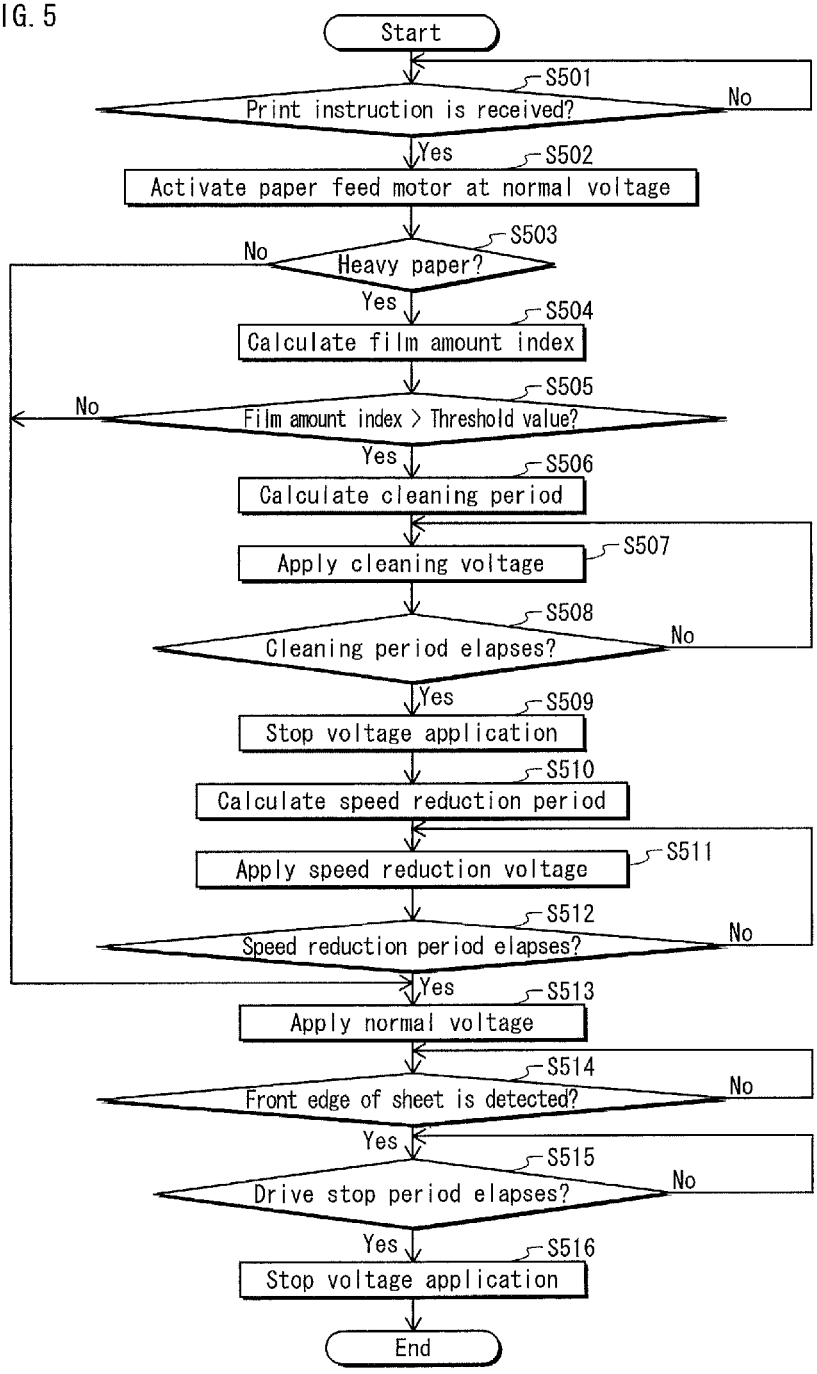
FIG. 5 is a flowchart showing operations of removing a carbon film deposited on a commutator performed by the control board 200.

FIG. 5 is a flowchart showing the operations of removing a carbon film deposited on the commutator performed by the control board 200. As shown in FIG. 5, upon receiving a print instruction using an NIC 303 via the communication network (S501: YES), the CPU 300 applies, to the paper feed motor 211, a voltage in accordance with a type of recording sheets S designated by the print instruction (hereinafter, normal voltage) to activate the paper feed motor 211 (S502). When the designated type of recording sheets S indicates heavy paper (S503: YES), the CPU 300 calculates a film amount index indicating an amount of a carbon film formed on the outer circumferential surface of the commutator of the paper feed motor 211 (S504).

In the present embodiment, a heavy paper is defined as a recording sheet having a basis weight of 91 g/m$^2$ or more, and a plain paper is defined as a recording sheet having a basis weight of 90 g/m$^2$ or less. When conveying heavy papers, the paper feed motor 211 and other brush motors are each controlled so as to drive at a rotational speed of 800 min$^{-1}$. When conveying plain papers, the paper feed motor 211 and other brush motors are each controlled so as to drive at a rotational speed of 3200 min$^{-1}$.

Also, the amount of a carbon film formed on the outer circumferential surface of the commutator of the brush motor is substantially proportional to the product of the rotational speed and the cumulative rotational period of the brush motor. For this reason, in the present embodiment, the film amount index is calculated by multiplying the rotational speed and the cumulative rotational period of the brush motor. Note that the cumulative rotational period of the brush motor indicates a rotational period since the most recent removal of a carbon film is complete.

When the film amount index calculated in Step S504 is higher than a predetermined threshold value (S505: YES), the CPU 300 calculates a period necessary for removing a carbon film (hereinafter, cleaning period) (S506). In the present embodiment, in order to remove a carbon film, the CPU 300 increases the average voltage applied to the commutator to cause insulation breakdown. As the average voltage for causing insulation breakdown, a normal voltage for conveying plain papers (hereinafter, plain paper voltage) is used in the present embodiment. Calculation of the cleaning period in Step S506 is specifically performed as follows. Experiments are performed to measure a period necessary for removing a carbon film by application of the plain paper voltage. The CPU 300 refers to a table resulting from the experiments to calculate a cleaning period.

Next, the CPU 300 changes the duty ratio of the PWM signal, and applies, to the commutator, a cleaning voltage (plain paper voltage) that is higher than a normal voltage for conveying heavy papers (hereinafter, heavy paper voltage) (S507). When the cleaning period elapses since the start of application of the cleaning voltage (S508: YES), the CPU 300 changes the duty ratio of the PWM signal, and temporarily stops voltage application to the commutator (S509).

Since the cleaning voltage is higher than the heavy paper voltage, the conveyance speed of the recording sheet S increases compared with the case where the heavy paper voltage is applied to the commutator. This results in move of the recording sheet (heavy paper) S too forward on the conveyance path. For this reason, the CPU 300 decreases the conveyance speed of the recording sheet S to correct the conveyance position of the recording sheet S. Firstly, the CPU 300 calculates a period necessary for reducing the conveyance speed of the recording sheet S (hereinafter, speed reduction period) (S510). The speed reduction period is calculated with use of an amount of excessive movement [mm] of the recording sheet S which is calculated based on the conveyance speed at application of the cleaning voltage and the cleaning period and a given speed reduction voltage which is lower than the heavy paper voltage.

Specifically, the speed reduction time $T_L$ is represented by the following equation.

$$T_L = \frac{V_H - V_O}{V_O - V_L} \cdot T_H$$

Note that $V_O$ denotes a conveyance speed at application of the heavy paper voltage (hereinafter, heavy paper conveyance speed), $V_H$ denotes a conveyance speed at application of the cleaning voltage, $V_L$ denotes a conveyance speed at application of the speed reduction voltage, and $T_H$ denotes a cleaning period.

Next, the CPU 300 controls a PWM signal to apply the speed reduction voltage to the commutator (S511). When the speed reduction period calculated in Step S510 elapses (S512: YES), the CPU 300 applies the heavy paper voltage to the paper feed motor 211 (S513). This corrects the conveyance position of the recording sheet S which has moved too forward on the conveyance path. When the type of recording sheets S designated in the print instruction indicates plain paper (S503: NO), the CPU 300 applies the plain paper voltage to the commutator (S513). When the type of recording sheets S designated in the print instruction indicates heavy paper and the film amount index is equal to or less than the threshold value (S505: NO), the CPU 300 applies the plain paper voltage to the commutator (S513).

Then, when the conveyance sensor 203 detects the front edge of the recording sheet S (S514: YES), the CPU 300 sets a timer. When the drive stop period elapses (S515: YES), the CPU 300 judges that the front edge of the recording sheet S reaches the drive stop position on the paper feed motor 211, and stops voltage application to the commutator (S516). As a result, the paper feed motor 211 is stopped, the rotation of the paper feed roller 121, the pickup roller 201, and the separation roller 202 is stopped, and the processing ends.

[5] Example of Operations by Control Board 200

The following describes a typical example of the operations performed by the control board 200 on the paper feed motor 211 in the case where heavy papers are conveyed.

(a) Example of Operations During Normal Time

Firstly, description is given on an example of operations during normal time in which the amount of a film deposited on the commutator is small.

Figure 6:
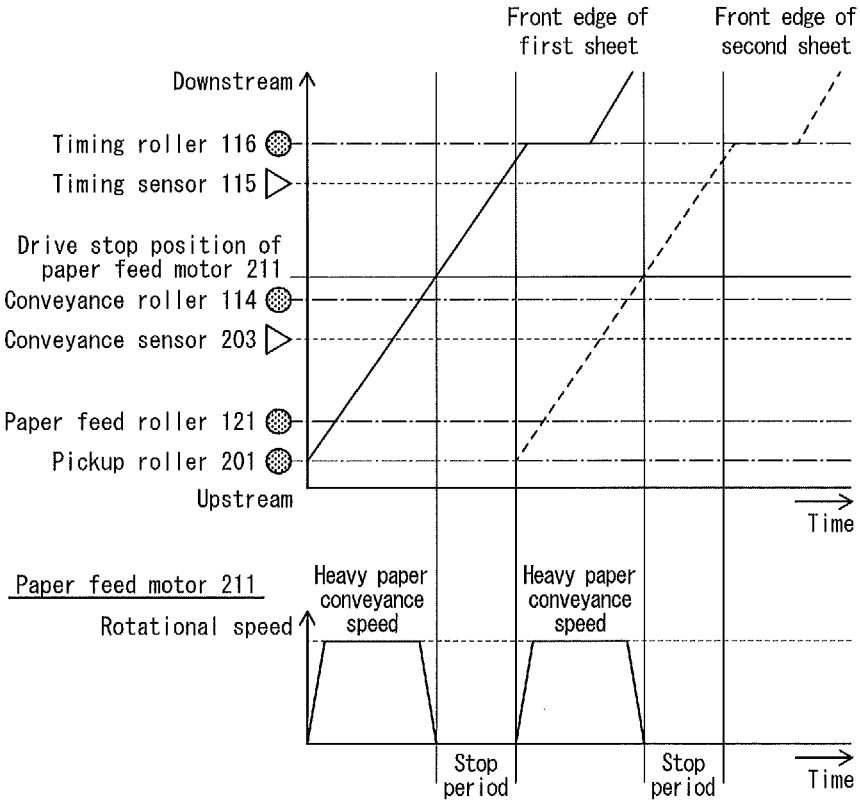
FIG. 6 shows operations made on recording sheets in the case where the film amount index of a carbon film deposited on the commutator of the brush motor 211 is equal to or less than a threshold value.

FIG. 6 exemplifies operations made on recording sheets (heavy papers) S in the case where the film amount index of a carbon film deposited on the commutator of the paper feed motor 211 is equal to or less than the threshold value. In FIG. 6, the position of each recording sheet S on the conveyance path is plotted on the ordinate, where the upside and the downside on the ordinate indicates the downstream and the upstream of the conveyance path, respectively. Also, the time is plotted on the abscissa. Furthermore, in FIG. 6, the solid line indicates the position of the front edge of the first piece of the recording sheets S, and the dashed line indicates the position of the front edge of the second piece of the recording sheets S, which is conveyed following the first piece.

As shown in FIG. 6, when the film amount index is equal to or less than the threshold value, the heavy paper voltage is applied to the paper feed motor 211, and the first piece of the recording sheets S is conveyed at the heavy paper conveyance speed. Then, when the conveyance sensor 203 detects the front edge of the first piece, the rotation of the paper feed motor 211 is stopped after the drive stop period. Then, in accordance with a timing of conveying the second piece of the recording sheets S, the paper feed motor 211 is again driven. In the same manner as in the case where the first piece is conveyed, the rotation of the paper feed motor 211 is stopped.

Note that in the case where plain papers are conveyed, the variation in position of the front edge of the recording sheet S is substantially the same as that shown in FIG. 6, excepting the following point. Since the conveyance speed of plain papers is higher than the conveyance speed of heavy papers, the variation in position of the front edge of each plain paper is represented by the gradient of graph that is greater than that shown in FIG. 6.

(b) Example of Operations of During Cleaning

Next, description is given on an example of operations during removing a carbon film deposited on the commutator.

Figure 7:
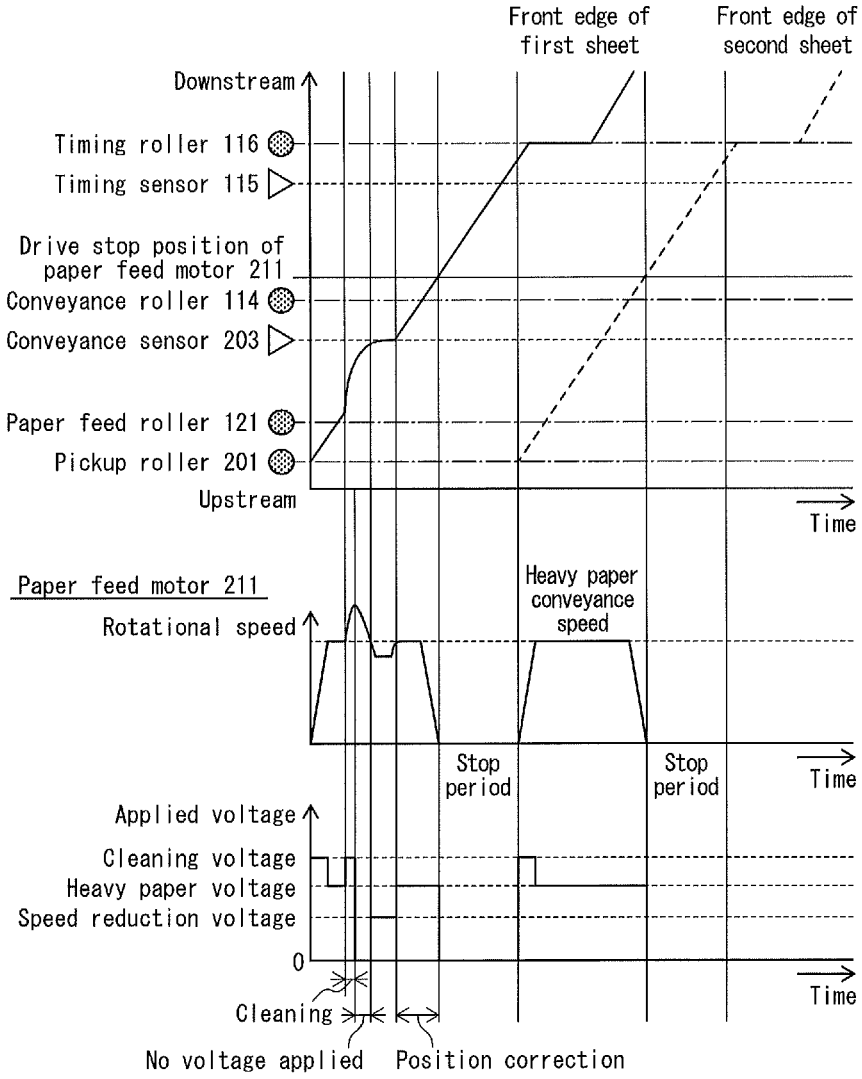
FIG. 7 exemplifies operations made on recording sheets during a cleaning operation.

FIG. 7 exemplifies variation in position of the front edge of the recording sheet S over time during a cleaning operation. As the same as in FIG. 6, the position of the front edge of the recording sheet S is plotted on the ordinate, and the time is plotted on the abscissa. Also, the solid line indicates the position of the front edge of the first piece of the recording sheets S, and the dashed line indicates the position of the front edge of the second piece of the recording sheets S. As shown FIG. 7, when the film amount exceeds the threshold value, the CPU 300 applies the cleaning voltage to the commutator to cause insulation breakdown of the film deposited on the commutator.

Since the cleaning voltage is higher than the heavy paper voltage, and accordingly the conveyance speed increases. As a result, the position of the front edge of the recording sheet S moves too forward. For this reason, the CPU 300 applies a voltage (speed reduction voltage) lower than the heavy paper voltage to the commutator to reduce the conveyance speed of the recording sheet S. This corrects the position of the front edge of the recording sheet S. Then, the CPU 300 applies the heavy paper voltage to the commutator so as to convey the recording sheet S at the heavy paper conveyance speed.

According to FIG. 7, removal of the carbon film is complete during conveyance of the first piece of the recording sheets S is conveyed, and no removal of a carbon film is performed during conveyance of the second and subsequent pieces of the recording sheets S.

[6] Modification Examples

Although the present invention has been described based on the above embodiment, the present invention is not of course limited to the above embodiment. The present invention includes the following modification examples.

(1) In the above embodiment, the description is given on the case where the cleaning voltage is applied for the cleaning period, which is determined in accordance with the amount of a film deposited on the outer circumferential surface of the commutator of the brush motor. However, the present invention is not limited to this, and the following structure may be employed for evenly performing a cleaning operation on the outer circumferential surface of the commutator.

In order to perform this, a brush motor relating to the present modification example has attached thereto an absolute encoder having a resolution capability of 128. The rotational angle of the brush motor is detected by the absolute encoder, and the outer circumferential surface of the commutator is cleaned for each rotational angle.

Figure 8:
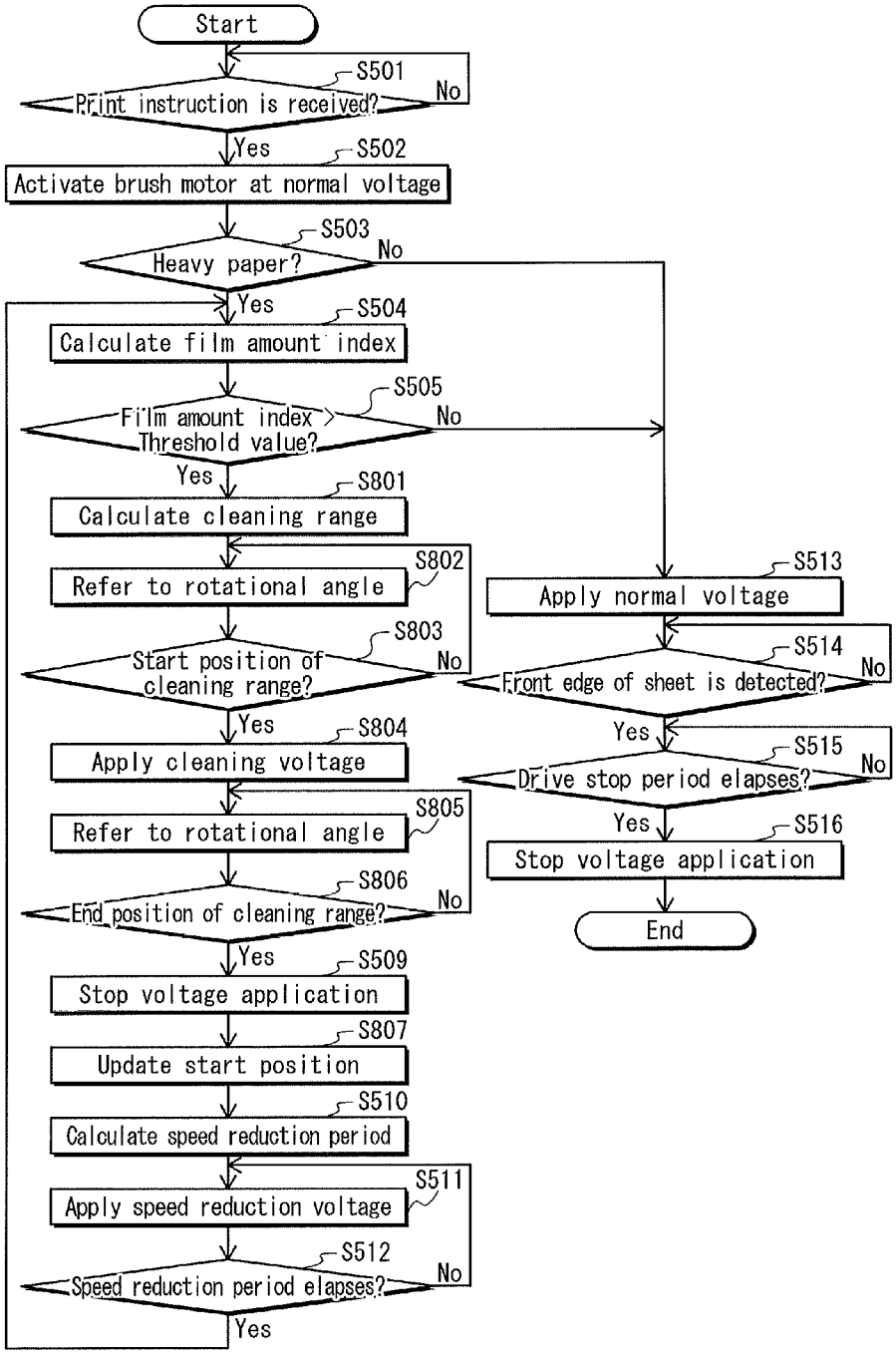
FIG. 8 is a flowchart showing cleaning processing relating to a modification example of the present invention.

FIG. 8 is a flowchart showing cleaning processing relating to the present modification example. Steps shown in FIG. 8 corresponding to Step shown in FIG. 5 have the same step numbers as those in FIG. 5. For Steps shown in FIG. 8 having the same step numbers as those in FIG. 5, refer to the above description on FIG. 5.

As shown in FIG. 8, when the film amount index exceeds the threshold value (S505: YES), the CPU 300 calculates a cleaning range (S801). The cleaning range is represented by the central angle and the start position of an arc of the cleaning range, when seen in a cross-section of the commutator perpendicular to the rotational axis thereof. Also, the central angle of the cleaning range is calculated with use of the cleaning period and the rotational speed of the brush motor such as described in the above embodiment.

The start position in the cleaning range is represented by the number of zero to 127 corresponding to the resolution capability of the absolute encoder, and is stored in the non-volatile memory. Furthermore, the central angle is also represented by the detection number of the absolute encoder. In the case where, for example, the start position is represented by the detection number of zero and the central angle is 90 degree (the detection number of zero to the detection number of 31), a range represented by the detection number of zero to the detection number of 31 is cleaned. The reason why the start position in the cleaning range is stored in the non-volatile memory is in order to start removal of a carbon film from the recorded start position in the cleaning range after power-off and then of power-on.

Then, the control unit 300 refers to the rotational angle detected by the absolute encoder (S802). When the detection position indicated by the detection number of the absolute encoder reaches the start position in the cleaning range (S803: YES), the CPU 300 applies the cleaning voltage to the commutator (S804). The CPU 300 further refers to the rotational angle detected by the absolute encoder (S805). When the commutator rotates by the central angle corresponding to the cleaning period and the detection position reaches the end position in the cleaning range (S806: YES), the CPU 300 temporarily stops voltage application (S509). Then, the CPU 300 updates the start position in the cleaning range (S807), and performs speed reduction processing of Step S510 and subsequent processing.

The start position in the cleaning range is updated by storing, in the non-volatile memory, the sum of the start position in the cleaning range and the central angle at the most recent cleaning operation. In the case where for example the most recent cleaning operation has been performed on a cleaning range where the start position is represented by the detection number of zero and the central angle is 90 degree (the detection number of zero to the detection number of 31), the detection number of 32 (=31+1) is stored in the non-volatile as a next start position in the cleaning range.

Figure 9:
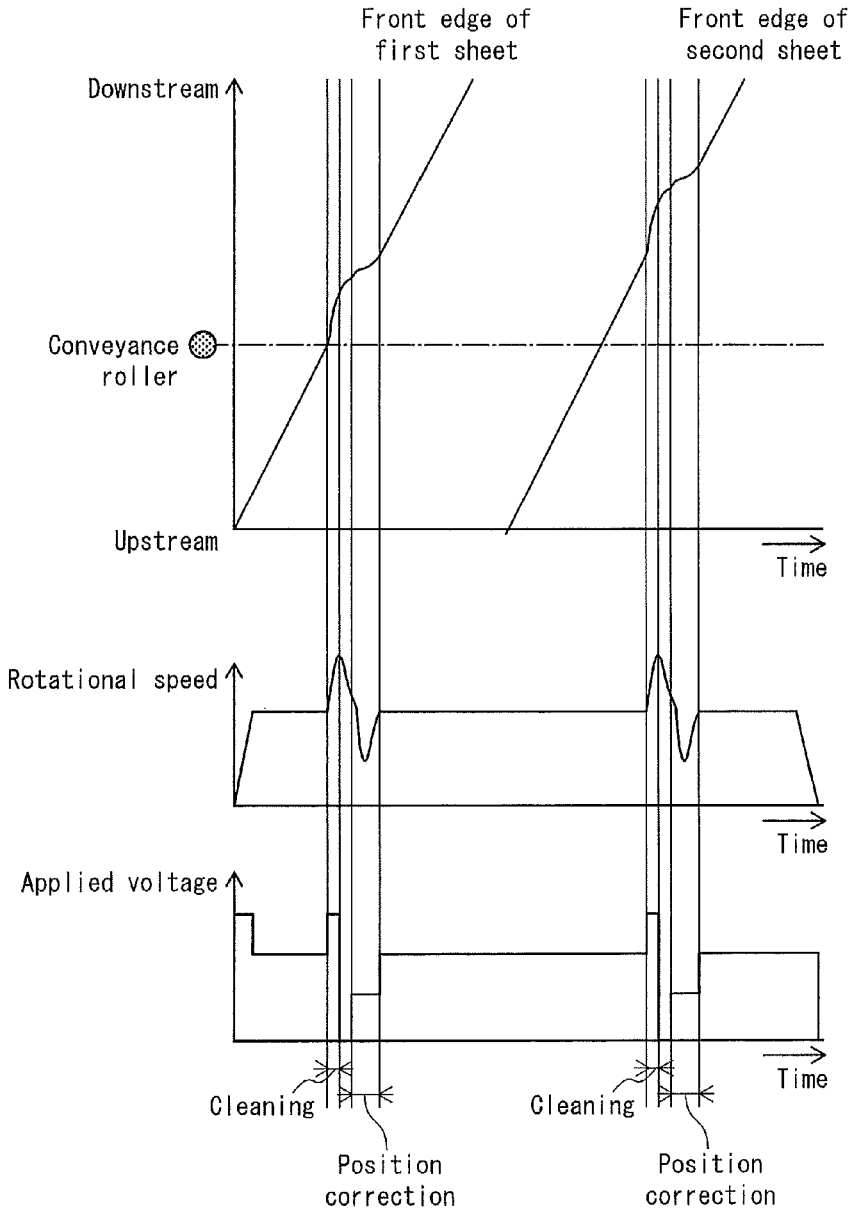
FIG. 9 shows operations of conveying recording sheets relating to a modification example of the present invention.

FIG. 9 shows operations of conveying a recording sheet S relating to the present modification example. In FIG. 9, graphs indicate variation in position of the front edge of each of recording sheets S over time, variation in rotational speed of the conveyance roller over time, and variation in applied voltage over time, in order from the top to the bottom. As shown in FIG. 9, when the first piece of the recording sheets S is conveyed, a cleaning range having the start position represented by the detection number of zero to the end position represented by the detection number of 31 is cleaned in accordance with the film amount index. Also, when the second piece of the recording sheets S is conveyed, a cleaning range having the start position represented by the detection number of 32 to the end position represented by the detection number of 63 is cleaned in accordance with the film amount index. In this case, it is necessary to wait for start of a cleaning operation until the detection position indicated by the detection number of the absolute encoder reaches the start position in the cleaning range. Accordingly, the first piece and the second piece differ from each other in timing of starting a cleaning operation (position of the front edge of the recording sheet S).

With the above structure, it is possible to evenly clean the outer circumferential surface of the commutator by moving the start position in the cleaning range forward in turn. This enables to efficiently and certainly remove a carbon film deposited on the outer circumferential surface of the commutator.

Also, the following structure may be employed. Assume that the outer circumferential surface of the commutator is divided in the circumferential direction thereof into a plurality of regions. In the case where a film amount index for each of the regions exceeds the threshold value independently from the amount of a carbon film deposited on the outer circumferential surface of the commutator, each time one piece of the recording sheets S is conveyed, a cleaning operation is performed on only one region whose film amount index exceeds the threshold value. This structure also enables to evenly remove a carbon film deposited on the outer circumferential surface of the commutator.

(2) In the above embodiment, the description is given on the case where a cleaning operation on the paper feed motor 211 is complete while the first piece of recording sheets S is conveyed. However, the present invention is not of course limited to this, and a cleaning operation on the brush motor may be complete while a plurality pieces of recording sheets S are conveyed.

Assume the following case for example. A carbon film is deposited on a commutator of a brush motor (hereinafter, upstream motor) that drives a conveyance roller (hereinafter, upstream roller) provided upstream on the conveyance path of recording sheets S, to the extent that a cleaning operation is necessary. Compared with this, a carbon film is deposited on a commutator of a brush motor (hereinafter, downstream motor) that drives a conveyance roller (hereinafter, downstream roller) provided downstream on the conveyance path of recording sheets S, but not to the extent that a cleaning operation is necessary.

In this case, if a cleaning operation is performed on only the upstream motor, a sag of the recording sheet S occurs on the conveyance path between the upstream roller and the downstream roller. This is because the upstream roller is higher in conveyance speed than the downstream roller. If this sag increases too much, the recording sheet S collides against a guide member which guides the recording sheet S to cause a noise. In order to avoid such occurrence of a noise, it is possible to employ the following structure for example.

Figure 10:
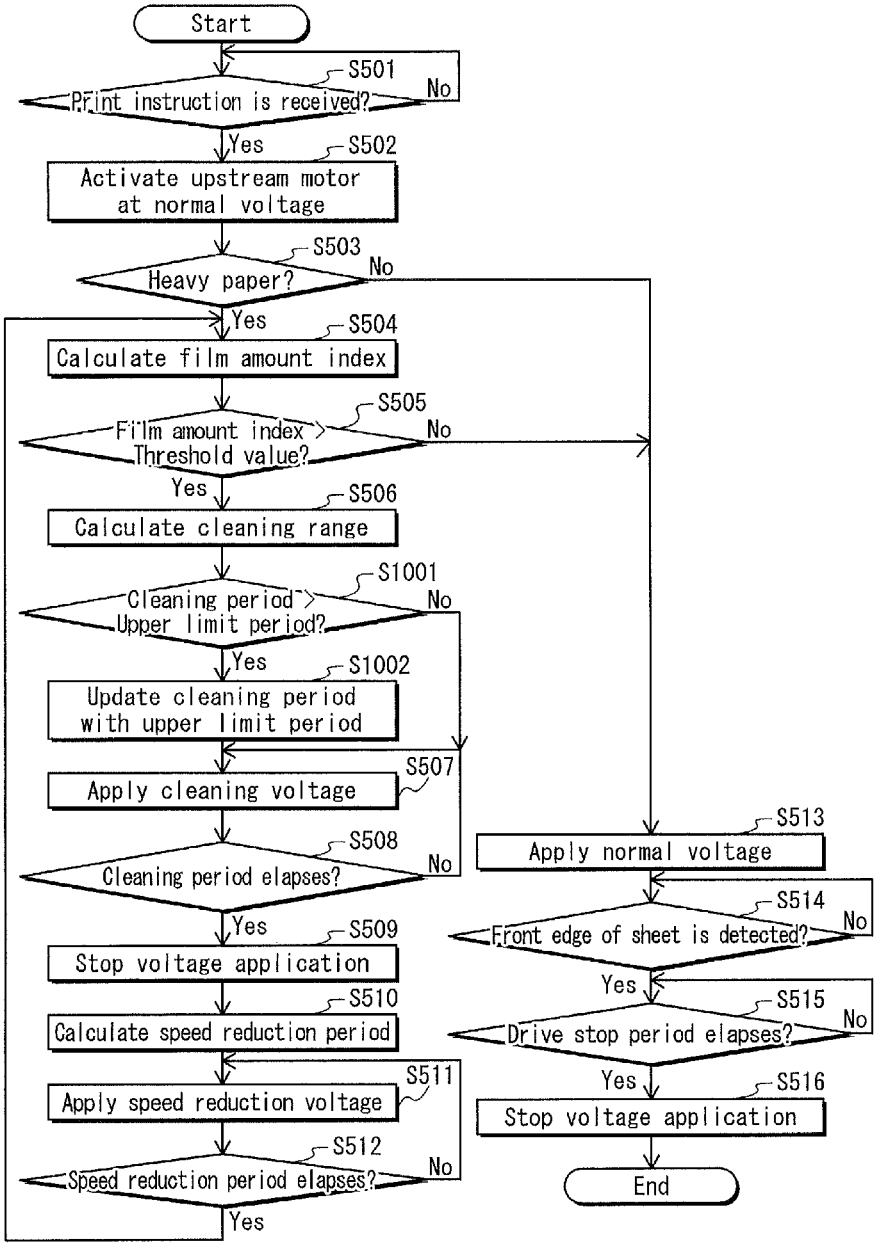
FIG. 10 is a flowchart showing processing of controlling voltage application to a commutator of an upstream motor relating to a modification example of the present invention.

FIG. 10 is a flowchart showing processing of controlling voltage application to the commutator of the upstream motor. Note that Steps shown in FIG. 10 corresponding to those in the flowchart in FIG. 5 have the same step numbers as those in the flowchart in FIG. 5. Also, the paper feed motor in FIG. 5 is replaced with the upstream motor in FIG. 10. As shown in FIG. 10, the film amount index of a film deposited on the commutator of the upstream motor exceeds the threshold value (S505: YES), the CPU 300 calculates a cleaning period (S506).

When the calculated cleaning period exceeds the upper limit period (S1001: YES), the CPU 300 updates the upper limit period with the calculated cleaning period (S1002). Note that the upper limit period is a period for the recording sheet S, which does not sag, to sag and collide against the guide member. The following describes calculation of the upper limit period.

The following equation is satisfied, where the sag amount of the recording sheet S is L, the difference in conveyance speed between the upstream roller and the downstream roller is $V_d$, and the cleaning period of the upstream roller is $T_c$, and the distance between the upstream roller and the downstream roller is $D_r$.

$$L=V_d \times T_c \times D_r$$

Figure 11:
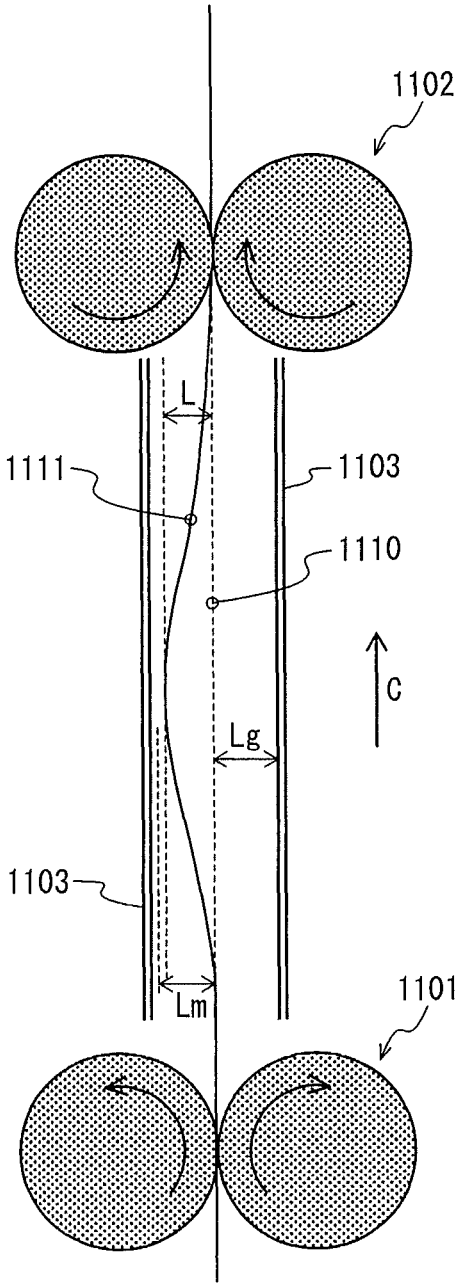
FIG. 11 is a cross-sectional view exemplifying a recording sheet that sags due to the difference in rotational speed between an upstream conveyance roller and a downstream conveyance roller.

FIG. 11 is a cross-sectional view exemplifying a recording sheet S that sags due to the difference in rotational speed between the upstream conveyance roller and the downstream conveyance roller. As shown in FIG. 11, a recording sheet 1111 is conveyed by being caught by both an upstream roller 1101 and a downstream roller 1102. Also, the upstream roller 1101 rotates at a speed higher than the downstream roller 1102 because of cleaning on a brush motor that rotates the upstream roller 1101. This causes the recording sheet 1111 to sag. As shown in FIG. 11, the sag amount L of the recording sheet 1111 is represented by a distance between the conveyance path 1110 while the recording sheet 1111 does not sag and a part of the recording sheet 1111 that is most distant from the conveyance path 1110 while the recording sheet 1111 sags.

While the recording sheet 1111 is conveyed along a guide member 1103, when the sag amount L of the recording sheet 1111 increases, the recording sheet 1111 collides against the guide member 1103 to cause a noise. For this reason, it is necessary to control conveyance of the recording sheet 1111 such that the sag amount L of the recording sheet 1111 is less than a distance $L_g$ between the conveyance path 1110 of the recording sheet 1111 and the guide member 1103 while the recording sheet 1111 does not sag.

In this case, the sag amount L of the recording sheet 1111 might be influenced by the slip between the recording sheet 1111 and the upstream roller 1101 or the downstream roller 1102, the precision of the diameter of the upstream roller 1101, the downstream roller 1102, and so on (including variation in diameter due to abrasion), for example. Accordingly, in consideration of margins for the precision of the diameter and so on, it is necessary to control conveyance of the recording sheet 1111 with use of a distance $L_m$ smaller than the distance $L_g$ as a threshold value for the sag amount to avoid the recording sheet 1111 from colliding against the guide member 1103.

A threshold value $L_m$ is represented by the following equation, where $L_g$ denotes the distance between the conveyance path 1110 of the recording sheet 1111 and the guide member 1103 while the recording sheet 1111 does not sag, and c denotes a correction coefficient in consideration of the slip ratio between the recording sheet 1111 and the upstream roller 1101 or the downstream roller 1102 and the precision of the diameter of the rollers.

$$L_m = L_g \times (1-c)$$

Based on the above equation, the upper limit period $T_m$ of cleaning period is represented by the following equation.

$$T_m = \frac{L_m}{V_d \times D_r} = \frac{L_g \times (1-c)}{V_d \times D_r}$$

Then, the CPU 300 applies the cleaning voltage to the commutator (S507). When the cleaning period elapses (S508: YES), the CPU 300 temporarily stops voltage application to the commutator. The CPU 300 calculates a speed reduction period (S510), and applies the speed reduction voltage to the commutator (S511).

When the speed reduction period elapses since the start of application of the speed reduction voltage (S512: YES), the CPU 300 calculates a film amount index of a carbon film remaining on the commutator after a cleaning operation (S504). This film amount index results from subtracting an amount of a film removed in the cleaning operation from the film amount calculated the last time. When the film amount index of the remaining film exceeds the threshold value (S505: YES), the CPU 300 repeatedly performs the processing of Step S506 and subsequent Steps as described above.

When the film amount index of the remaining film is equal to or less than the threshold value (S505: NO), the CPU 300 conveys recording sheets S at the heavy paper conveyance speed (S513). Then, when the drive stop period elapses (S515: YES), the CPU 300 stops voltage application to the commutator (S516), and ends the processing.

Figure 12:
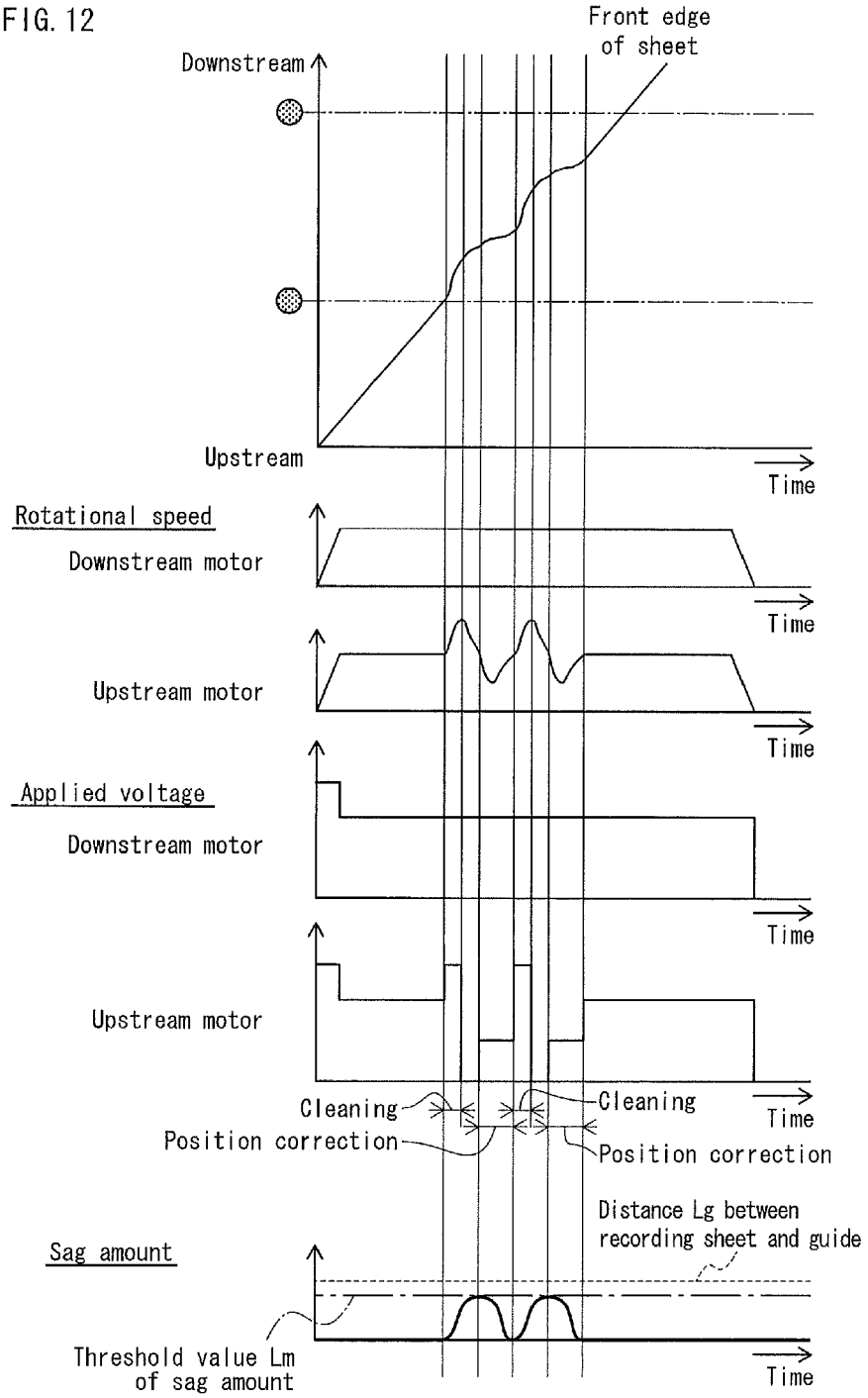
FIG. 12 shows operations of conveying a recording sheet relating to a modification example of the present invention.

FIG. 12 shows operations of conveying a recording sheet S relating to the present modification example. In FIG. 12, graphs indicate variation in position of the front edge of the recording sheet S over time, variation in rotational speed of each of the downstream roller and the upstream roller, and variation in voltage applied to each of the downstream roller and the upstream roller, and variation in sag amount of the recording sheet S over time, in order from the top to the bottom. In each of the graphs, the time is plotted on the abscissa. While the upstream motor is cleaned, the downstream motor is not cleaned. Accordingly, as shown in FIG. 12, while the rotational speed of the downstream motor is constant, the rotational speed of the upstream motor varies because of control on the voltage applied to the upstream motor.

The CPU 300 performs the control on applied voltage such that the sag amount L of the recording sheet S, which is caused by the difference in rotational speed between the upstream roller and the downstream roller, does not exceed the threshold value $L_m$. Specifically, the CPU determines a cleaning period such that the sag amount L of the recording sheet S does not exceed the threshold value $L_m$, and then starts a cleaning operation. When the cleaning period elapses, the CPU 300 corrects the conveyance position of the recording sheet S. This correction is performed by conveying the recording sheet S at a speed that is lower than the heavy paper conveyance speed. Accordingly, the downstream roller rotates faster than the upstream roller, and this eliminates the sag of the recording sheet S (see the graph of the sag amount).

Then, in the case where a carbon film is deposited on the commutator of the upstream motor and cleaning is necessary, the CPU 300 again determines a cleaning period such that the sag amount L of the recording sheet S does not exceed the threshold value $L_m$, and then starts a cleaning operation. As shown in the graph on the sag amount, although the sag amount L of the recording sheet S again increases due to the second cleaning operation, the cleaning period elapses before the sag amount L reaches the threshold value $L_m$. Accordingly, it is possible to avoid the recording sheet S from colliding against the guide member.

Then, the conveyance position of the recording sheet S is corrected, as a result the sag is eliminated and the sag amount L reaches zero. In the operation example shown in FIG. 12, the carbon film is removed sufficiently by the second cleaning operation, and accordingly the third cleaning operation is not performed.

In this way, it is possible to prevent occurrence of a noise due to collision of the recording sheet S against the guide member while a cleaning operation is performed to remove a carbon film deposited on the commutator of the upstream motor. Furthermore, even if the recording sheet S collides against the guide member, it is possible to prevent crease and jam of the recording sheet S.

(3) In the above embodiment, the description is given on the case where the conveyance position of the recording sheet S is corrected by reducing the rotational speed of a brush motor on which a cleaning operation has been performed. However, the present invention is not of course limited to this, and the conveyance position of the recording sheet S may be corrected by reducing the rotational speed of a brush motor that is different from the brush motor on which the cleaning operation has been performed.

Figure 13:
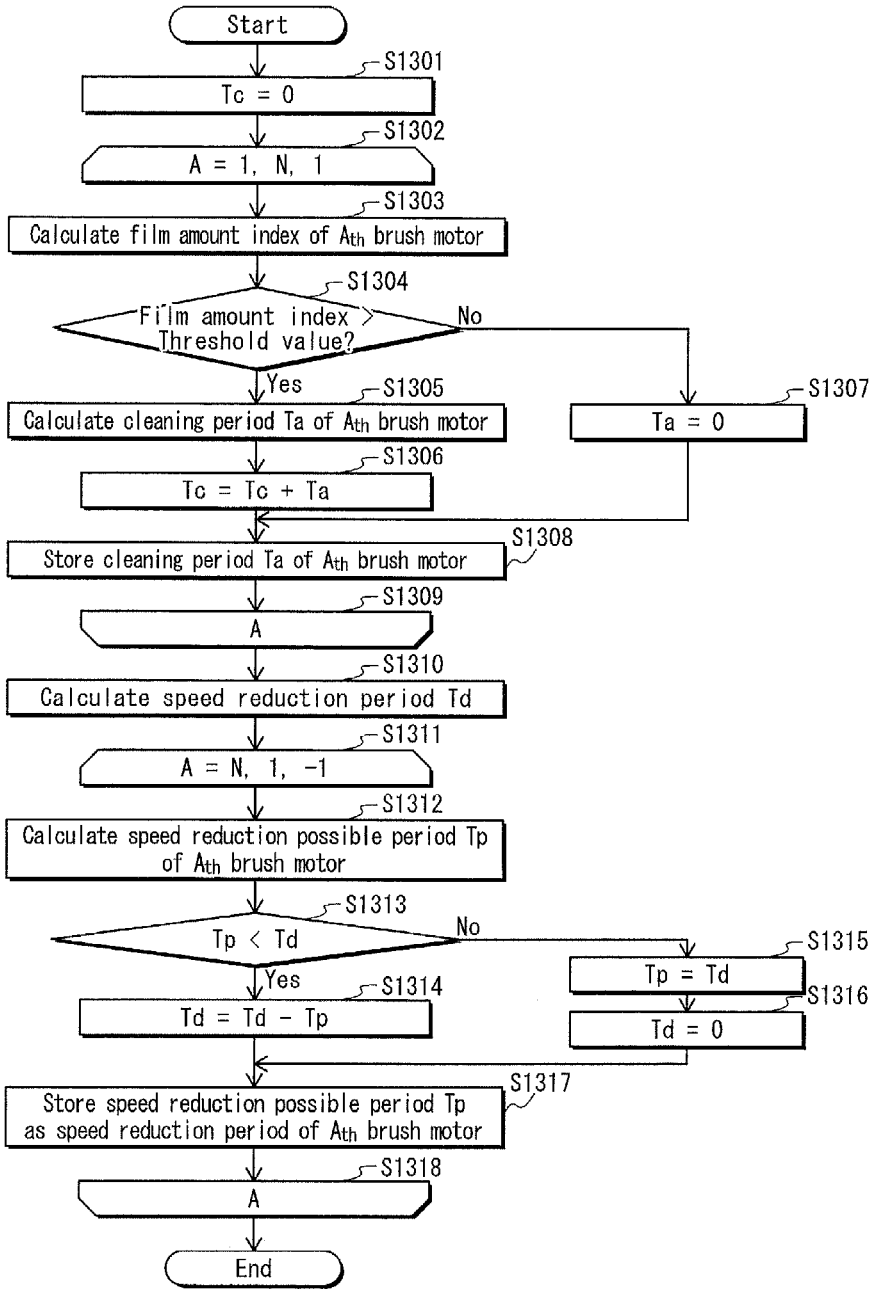
FIG. 13 is a flowchart showing processing of allocating a speed reduction period relating to a modification example of the present invention.

Accordingly, in the present modification example, each time the image forming apparatus 1 receives a print instruction, a speed reduction period is shared among a plurality of brush motors. FIG. 13 is a flowchart showing processing of allocating a speed reduction period. As shown in FIG. 13, the CPU 300 initializes the value of a variable $T_c$ that stores the sum of cleaning periods to zero (S1301), and repeatedly performs loop processing of Steps S1302 to S1309 by N times which is equivalent in number to the brush motors.

In this loop processing, the brush motor numbers from one to N are assigned to the respective brush motors that drives conveyance rollers that are provided on the conveyance path of recording sheets S from the most upstream, respectively. The variable A stores the brush motor number of each of the brush motors. In the loop processing of Steps S1302 to S1309, the value of the variable A is incremented by one from one to N.

Specifically, the CPU 300 calculates the film amount index for the $A_{th}$ brush motor (S1303). When the calculated film amount index exceeds the threshold value (S1304: YES), the CPU 300 calculates a cleaning period Ta of the $A_{th}$ brush motor (S1305), and adds the calculated cleaning period Ta to the sum $T_c$ of cleaning periods (S1306). When the film amount index is equal to or less than the threshold value (S1304: NO), the CPU 300 sets the cleaning period Ta of the $A_{th}$ brush motor to zero (S1307).

After performing the processing of Steps S1306 and S1307, the CPU 300 stores therein the cleaning period Ta of the $A_{th}$ brush motor (S1308). The CPU 300 repeatedly performs the above processing by the number of times which is equivalent in number to the brush motors, and calculates the sum $T_d$ of speed reduction periods based on the sum $T_c$ of cleaning periods (S1310). Next, the CPU 300 repeatedly performs loop processing of Steps S1311 to S1318 N times which is equal in number to the brush motors, while decrementing the value of the variable A that stores the number of each of the brush motors by one from N to one.

Specifically, the CPU 300 calculates a speed reduction possible period $T_p$ of the $A_{th}$ brush motor (S1312). Here, the speed reduction possible period $T_p$ of the $A_{th}$ brush motor is a period resulting from subtracting the cleaning period $T_a$ calculated in Step S1305 from the conveyance period of the recording sheet S by the $A_{th}$ brush motor. When the calculated speed reduction possible period $T_p$ is less than the sum $T_d$ of speed reduction periods (S1313: YES), the CPU 300 updates the sum $T_d$ of speed reduction periods with a value resulting from subtracting the speed reduction possible period $T_p$ from the sum $T_d$ of speed reduction periods (S1314).

When the speed reduction possible period $T_p$ is equal to or greater than the sum $T_d$ of speed reduction periods (S1313: NO), the CPU 300 updates the speed reduction possible period $T_p$ with the sum $T_d$ of speed reduction periods (S1315), and updates the sum $T_d$ of speed reduction periods with a value of zero (S1316). After performing the processing of Steps S1314 and S1316, the CPU 300 stores therein the speed reduction possible period $T_p$ as the speed reduction period of the $A_{th}$ brush motor (S1317). Then, after completing the loop processing, the CPU 300 ends all the processing. Note that the sum $T_d$ of speed reduction periods reaches zero, the CPU 300 may terminate the loop processing even if the value of the variable A has not yet reached one.

Figure 14:
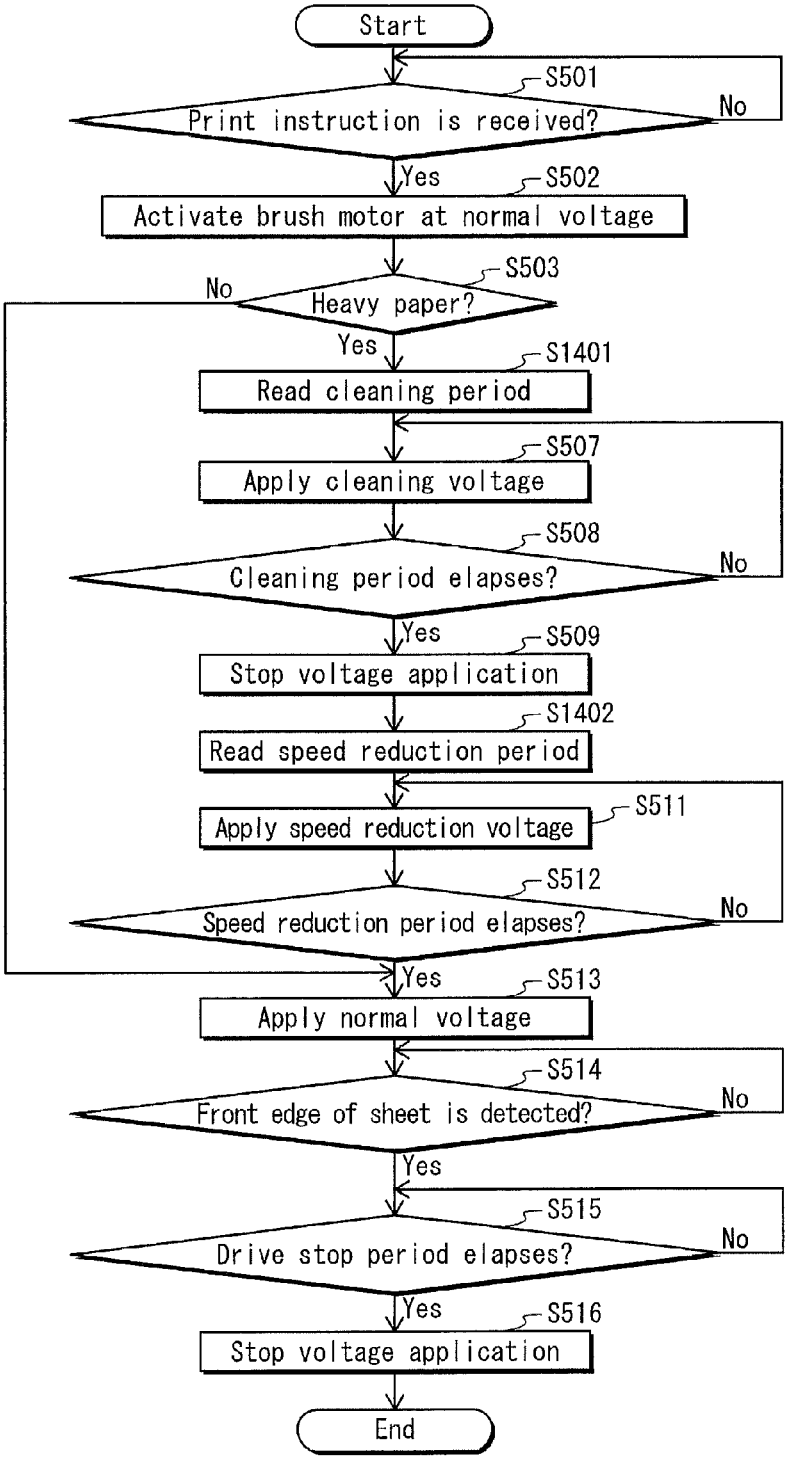
FIG. 14 is a flowchart showing processing of controlling voltage application to a commutator of a brush motor relating to a modification example of the present invention.

FIG. 14 is a flowchart showing processing of controlling voltage application to the commutator of the brush motor. Note that Steps shown in FIG. 14 corresponding to those in the flowchart in FIG. 5 have the same step numbers as those in the flowchart in FIG. 5. Also, the paper feed motor in FIG. 5 is replaced with the brush motor in FIG. 14. As shown in FIG. 14, when the type of recording sheets S designated in a print instruction indicates heavy paper (S503: YES), the CPU 300 calculates a cleaning period of the brush motor (S1401).

Then, the CPU 300 applies the cleaning voltage to the brush motor for the cleaning period (S507 and S508). After temporarily stopping voltage application, the CPU 300 calculates a seed reduction period of the brush motor (S1402). Then, the CPU 300 applies the speed reduction voltage to the brush motor for the speed reduction period (S511 and S512), and then performs processing of Step S513 and subsequent steps in the same manner as in FIG. 5.

Figure 15:
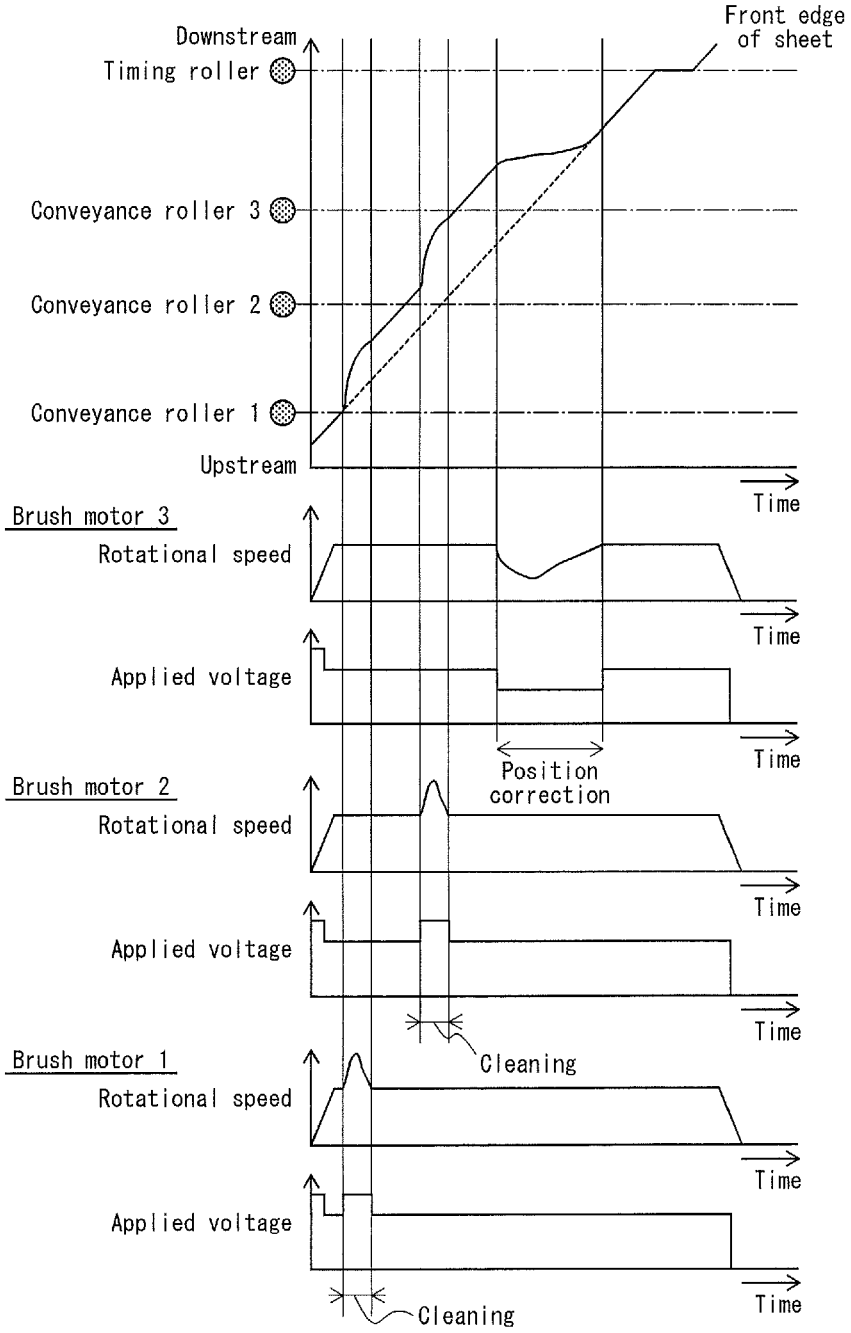
FIG. 15 exemplifies operations of conveying a recording sheet relating to a modification example of the present invention.

FIG. 15 shows operations of conveying a recording sheet S relating to the present modification example. In FIG. 15, graphs indicate variation in position of the front edge of the recording sheet S over time, variation in rotational speed and applied voltage for each of brush motors 3 to 1 over time, in order from the top to the bottom. In each of the graphs, the time is plotted on the abscissa. According to FIG. 15, a carbon film is deposited on respective commutators of the brush motors 1 and 2 which drive conveyance rollers 1 and 2, respectively, to the extent that a cleaning operation is necessary. Compared with this, a carbon film is deposited on respective commutators of brush motors which drive the conveyance roller 3 and the timing roller, but not to the extent that a cleaning operation is necessary.

In this situation, the cleaning voltage is applied to the respective commutators of the brush motors 1 to 2 during conveyance of the recording sheet S. As a result, the conveyance position of the recording sheet S moves forward compared with conveyance at the normal conveyance speed. The speed reduction period for a cleaning operation for the brush motors 1 and 2 is allocated to the brush motor 3. In other words, although it is unnecessary to perform a cleaning operation on the brush motor 3, the speed reduction period is allocated to the brush motor 3 because there is an enough period to reduce the conveyance speed of the recording sheet S. As a result, the conveyance position of the recording sheet S is corrected before the front edge of the recording sheet S reaches the timing roller.

(4) In the above embodiment, the description is given on the case where a cleaning operation is performed starting with the brush motor that drives the conveyance roller that is provided more upstream on the conveyance path. However, the present invention is not of course limited to this, and the following structure may be employed.

Specifically, in the case where one recording sheet S is simultaneously caught by both the upstream roller and the downstream roller, if the cleaning voltage is applied to the downstream motor in order to perform a cleaning operation on only the downstream motor, the rotational speed of the downstream motor does not sufficiently increase. This is because the recording sheet S is caught also by the upstream roller and this causes a resistance. As a result, a cleaning operation might be performed on only a range that is narrow than a cleaning range corresponding to a cleaning period.

In order to solve this problem due to the difference in conveyance speed between the conveyance rollers, it is possible to employ the following structure. Specifically, a cleaning operation is simultaneously performed on each of a plurality of respective brush motors that drive a plurality of conveyance rollers which catch the same recording sheet S to rotate.

Figure 16:
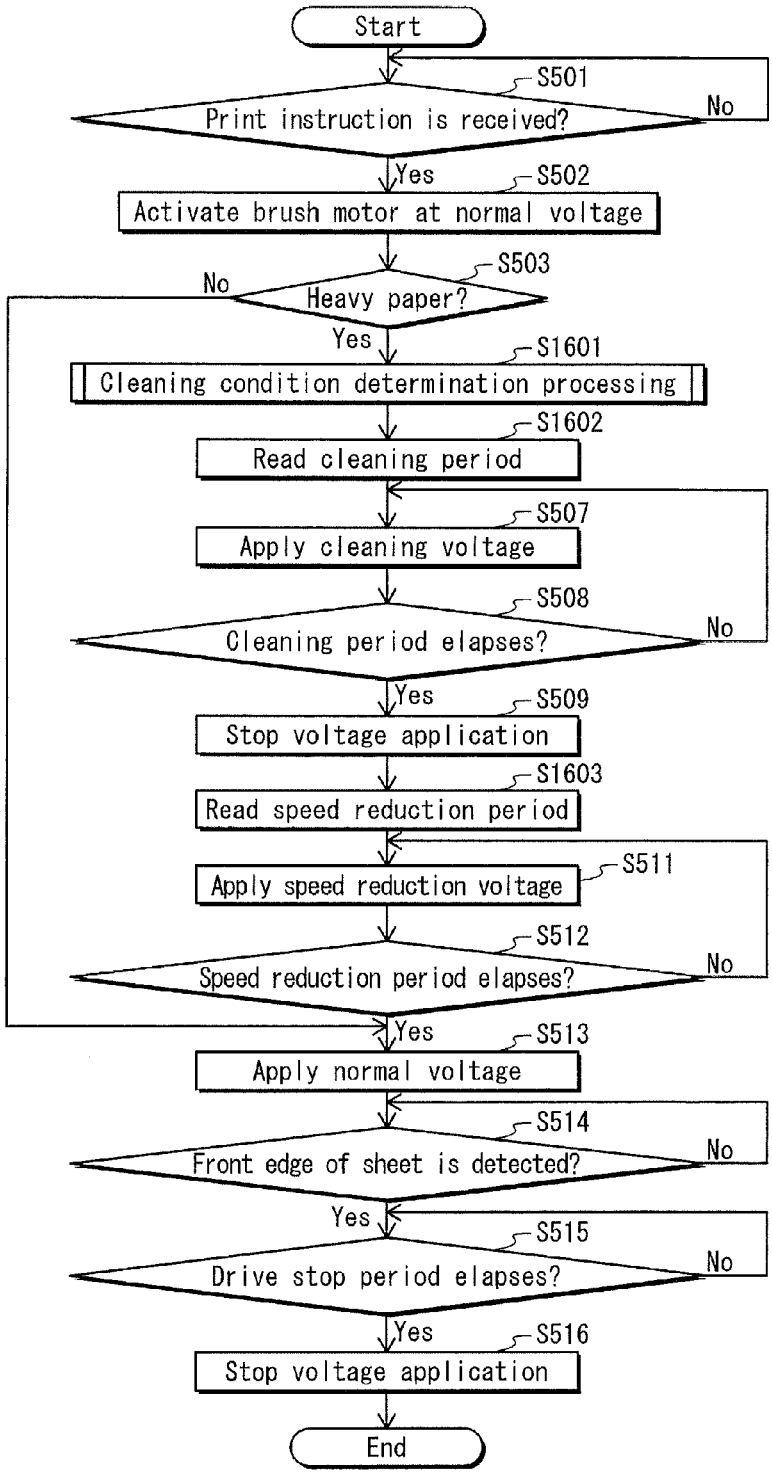
FIG. 16 is a flowchart showing cleaning processing relating to a modification example of the present invention.

FIG. 16 is a flowchart showing cleaning processing relating to the present modification example. Steps shown in FIG. 16 corresponding to Step shown in FIG. 5 have the same step numbers as those in FIG. 5. For Steps shown in FIG. 16 having the same step numbers as those in FIG. 5, refer to the above description on FIG. 5.

In the present modification example as shown in FIG. 16, when the type of recording sheets S designated in a print instruction indicates heavy paper (S503: YES), the CPU 300 performs cleaning condition determination processing (S1601).

Figure 17:
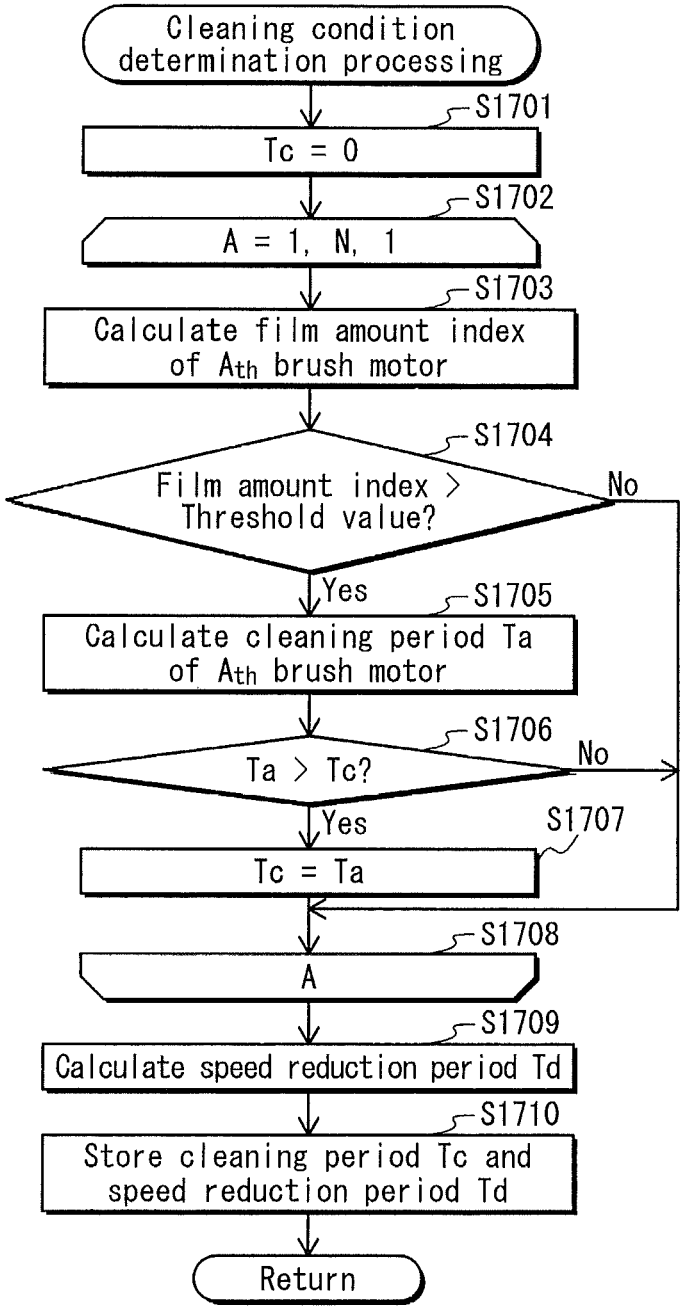
FIG. 17 is a flowchart showing cleaning condition determination processing relating to a modification example of the present invention.

FIG. 17 is a flowchart showing cleaning condition determination processing. As shown in FIG. 17, the CPU 300 initializes the value of a variable $T_c$ to zero (S1701), and repeatedly performs loop processing of Steps S1702 to S1708 N times which is equal in number to the conveyance rollers that catch the same recording sheet S.

In the loop processing, the CPU 300 calculates a film amount index for the $A_{th}$ brush motor (S1703). When the calculated film amount index exceeds the threshold value (S1704: YES), the CPU 300 calculates a cleaning period Ta of the $A_{th}$ brush motor (S1705). When the calculated cleaning period Ta exceeds the cleaning period $T_c$ (S1706: YES), the CPU 300 assigns the value of the variable $T_a$ to the variable $T_c$ (S1707).

In this way, it is possible to adopt the longest cleaning period $T_a$ as the cleaning period $T_c$. After performing the above loop processing on all the respective brush motors that rotate the conveyance rollers that catch the same recording sheet S, the CPU 300 calculates the speed reduction period $T_d$ in accordance with the calculated cleaning period $T_c$ (S1709). The CPU 300 stores therein the cleaning period $T_c$ and the speed reduction period $T_d$ (S1710), and then returns to the main routine (FIG. 16).

Next, the CPU 300 reads the cleaning period $T_c$ determined in the cleaning condition determination processing (S1602), and simultaneously applies the cleaning voltage to the commutators of all of the $1_{st}$ to the $N_{th}$ brush motors for the cleaning period $T_c$ (S507 and S508), and then stops voltage application (S509). Furthermore, the CPU 300 reads the speed reduction Td (S1603), and simultaneously applies the speed reduction voltage to the commutators of all of the $1_{st}$ to the $N_{th}$ brush motors for the speed reduction period Td (S511 and S512). The subsequent processing is the same as that shown in the flowchart in FIG. 5.

Figure 18:
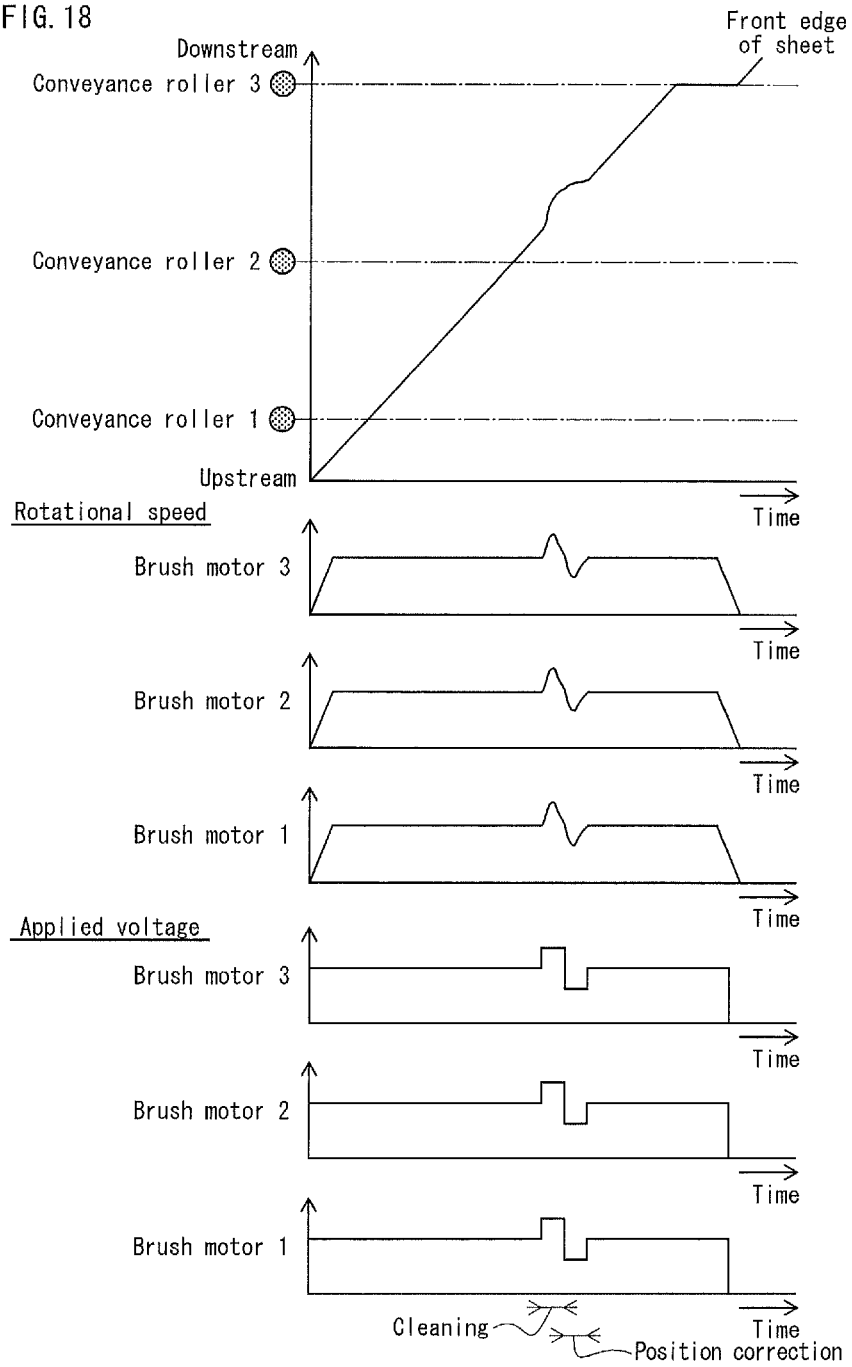
FIG. 18 exemplifies operations of conveying recording sheets relating to a modification example of the present invention.

FIG. 18 exemplifies operations of conveying recording sheets S relating to the present modification example. In FIG. 18, graphs indicate variation in position of the front edge of the recording sheet S over time, respective variation in rotational speed and applied voltage for voltage brush motors 3 to 1 over time, in order from the top to the bottom. In each of the graphs, the time is plotted on the abscissa. According to FIG. 18, a carbon film is deposited on a commutator of at least one of the brush motors 1 to 3, which rotate the conveyance rollers 1 to 3, respectively, to the extent that a cleaning operation is necessary.

Accordingly, the cleaning voltage is simultaneously applied to each of the respective commutators of the brush motors 1 to 3, and the conveyance position of the recording sheet S moves forwards compared with conveyance at the normal conveyance speed. Also, the speed reduction voltage corresponding to this cleaning operation is simultaneously applied to each of the respective commutators of the brush motors 1 to 3. In other words, in the case where a cleaning operation needs to be performed on the commutator of at least one of the brush motors 1 to 3, a cleaning operation is performed on the commutator of each of all the brush motors 1 to 3.

According to the present modification example as described above, it is possible to prevent deterioration in cleaning capability. Specifically, it is possible to avoid the case for example where the rotational speed of a commutator on which a cleaning operation is performed decreases due to the difference in conveyance speed between conveyance rollers, and as a result no cleaning is performed on some ranges on the commutator due to the reduction in rotational distance of the commutator for a cleaning period.

(5) In the above embodiment, the description is given on the case where recording sheets S are sequentially conveyed by the conveyance roller. However, there is a case where, in order to transfer a toner image onto a desired position on a recording sheet S, the timing roller temporarily stops conveying the recording sheet S. In consideration of such conveyance operations of the recording sheet S, it is possible to employ the following structure.

It is desirable to correct the conveyance position which has moved too forward on the conveyance path of the recording sheets S due to a cleaning operation, until the recording sheet S reaches a conveyance roller that is provided immediately upstream of the timing roller. For this reason, the position of the front edge of the recording sheet S may be corrected by each of the brush motors, for example.

Alternatively, as described in the above modification example (3), the speed reduction period may be shared among the respective brush motors that drive the conveyance rollers provided upstream of the timing roller on the conveyance path of recording sheets S. According to the present modification example, it is possible to prevent a subsequent recording sheet S from colliding against and interfere a precedent recording sheet S waiting before the timing roller, regardless of how to reduce the conveyance speed. As a result, it is possible to clean the commutator with no crease and jam of recording sheets S.

(6) In the above embodiment, the description is given on the case where a carbon film is removed, which are deposited on the outer circumferential surface of the commutator of the paper feed motor that rotates the paper feed roller to drive. However, the present invention is of course not limited to this. The effects of the present invention can be also achieved by applying to the case where a cleaning operation is performed on the outer circumferential surface of a commutator of a brush motor other than the paper feed motor, as long as the brush motor rotates a conveyance roller that conveys recording sheets S.

(7) In the above embodiment, the description is given on the case where the cleaning amount of a carbon film is controlled in accordance with the cleaning period. However, the present invention is not of course limited to this. Instead of the cleaning period, the cleaning amount of a carbon film may be controlled in accordance with the rotational frequency (the rotational angle) of the brush motor. In this case, instead of measuring the cleaning period by the timer, it is desirable to use a sensor for detecting the rotational frequency of the brush motor such as the absolute encoder described above.

Control may be performed as follows in the case where the rotational frequency of the brush motor is detected. For example, the rotational frequency is detected since the start of application of the cleaning voltage to the commutator. When the detected rotational frequency reaches a predetermined value calculated in accordance with the amount of deposited carbon film, application of the cleaning voltage is stopped. The similar control is performed in the case where the speed reduction voltage is applied to the commutator. When the detected rotational frequency reaches a predetermined value calculated in accordance with the correction amount of the conveyance position of the recording sheet S, application of the speed reduction voltage is stopped.

(8) In the above embodiment, the description is given on the case where the present invention is applied to a printer apparatus as an example of an image forming apparatus. However, the present invention is not of course limited to this, and the same effects can also be achieved by applying the present invention to an image forming apparatus other than the printer apparatus. Specifically, the present invention may be applicable to an image forming apparatus including an SFP (Single Function Peripheral) such as a copy apparatus and a facsimile apparatus, and an MFP (Multi Function Peripheral).

[7] Representative Effects of the Present Invention

The image forming apparatus relating to the present invention is an image forming apparatus comprising: a conveyance roller configured to convey recording sheets; a brush motor configured to drive the conveyance roller to rotate; and a control unit configured to control a rotational speed of the brush motor, wherein while the conveyance roller conveys a recording sheet, (i) the control unit applies voltage to an outer circumferential surface of a commutator of the brush motor to drive the brush motor to rotate by a predetermined rotation amount, so as to perform a cleaning operation to remove a film deposited on the outer circumferential surface, and (ii) the control unit reduces the rotational speed of the brush motor while not performing the cleaning operation, so as to correct a conveyance distance of the recording sheet.

With this structure, it is possible to clean the outer circumferential surface of the commutator of the brush motor, with no delay in image forming operations. This enables performance of a cleaning operation on the brush motor with no reduction in productivity of the image forming apparatus.

In this case, the image forming apparatus may further comprise: a deposition amount estimation unit configured to estimate an amount of a film deposited on the outer circumferential surface of the brush motor; and a rotational amount determination unit configured to determine the rotational amount such that the higher the estimated amount of the deposited film, the higher the rotational amount. With this structure, it is possible to certainly remove a deposited film even if the amount of the deposited film is large. Also, when the amount of deposited film is small, it is possible to save the time necessary for removing the deposited film.

Specifically, the image forming apparatus may further comprise: a recording unit configured to record therein a rotational speed and a cumulative rotational period of the brush motor after completion of a most recent cleaning operation; and a rotational amount determination unit configured to determine a rotational amount of the brush motor for a next cleaning operation, based on the rotational speed and the cumulative rotational period recorded in the recording unit.

Also, the image forming apparatus may further comprise: a deposition amount estimation unit configured to estimate an amount of a film deposited on the outer circumferential surface of the brush motor; and a cleaning prohibition unit configured to prohibit the control unit from performing a cleaning operation when the estimated amount of the deposited film is less than a threshold value. With this structure, when a film is not deposited too much on the outer circumferential surface of the commutators, it is possible to prevent performance of an unnecessary cleaning operation.

Also, the image forming apparatus may further comprise an end position recording unit configured to record therein an end position in a cleaning range where a most recent cleaning operation has been performed in a circumferential direction of the commutator, wherein the control unit may refer to the end position in the cleaning range recorded in the end position recording unit, so as to start a next cleaning operation from the recorded end position. With this structure, it is possible to evenly clean the outer circumferential surface of the commutators, without repeatedly cleaning the same cleaning range and repeatedly excluding some ranges from the cleaning same range.

Also, the image forming apparatus may further comprise: a downstream roller that is provided downstream of the conveyance roller on a conveyance path of recording sheets, and configured to convey recording sheets; and a rotational amount determination unit configured to determine the rotational amount, such that an amount of sag of a recording sheet during a cleaning operation is less than a threshold value, the amount of sag being calculated based on a conveyance distance between the conveyance roller and the downstream roller, a difference in conveyance speed between the conveyance roller and the downstream roller, and the rotational amount. With this structure, in the case where a recording sheet sags due to the difference in conveyance speed between the conveyance roller and the downstream roller during a cleaning operation, it is possible to prevent the sagged recording sheet from colliding against a guide member to cause a noise.

Also, the image forming apparatus may further comprise a timing roller configured to adjust a timing of conveying a recording sheet, such that a toner image carried on an intermediate transfer member is transferred onto a predetermined position on the recording sheet, wherein the plurality of conveyance rollers may be provided upstream of the timing roller on a conveyance path of recording sheets, and while any of the conveyance rollers conveys a recording sheet, the control unit may perform a cleaning operation on any of the plurality of brush motors that drive the conveyance rollers to rotate, and reduce a rotational speed of any of the brush motors. With this structure, it is possible to prevent a subsequent recording sheet from colliding against and interfere a precedent recording sheet waiting before the timing roller on the conveyance path.

In this case, while any of the conveyance rollers conveys a recording sheet, the control unit may perform a cleaning operation on one of the brush motors that drives the any conveyance roller to rotate, and reduce a rotational speed of the one brush motor. Alternatively, the correction distance may be appropriately shared among the conveyance rollers.

Also, the plurality of conveyance rollers may be provided on a conveyance path of recording sheets, and while the conveyance rollers simultaneously convey a recording sheet, the control unit may simultaneously perform a cleaning operation on each of respective brush motors that drive the conveyance rollers to rotate.

For example, assume that a single recording sheet is caught by both an upstream conveyance roller and a downstream conveyance roller that are provided upstream and downstream on the conveyance path, respectively. In the case where a cleaning operation is performed on a brush motor that drives the downstream conveyance roller and a cleaning operation is not performed on a brush motor that drives the upstream conveyance roller, the upstream conveyance roller is lower in conveyance speed than the downstream conveyance roller.

As a result, the rotational speed of the downstream conveyance roller decreases. This enables performance of the cleaning operation on only a range that is narrow than a desired cleaning range on the outer circumferential surface of the commutator of the brush motor that rotates the downstream conveyance roller to rotate. However, with the above structure, by matching the conveyance speed of the upstream conveyance roller to the conveyance speed of the downstream conveyance roller, it is possible to solve this problem.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An image forming apparatus comprising:

a conveyance roller configured to convey recording sheets;

a brush motor configured to drive the conveyance roller to rotate; and a control unit configured to control a rotational speed of the brush motor, wherein while the conveyance roller conveys a recording sheet, (i) the control unit applies voltage to an outer circumferential surface of a commutator of the brush motor to drive the brush motor to rotate by a predetermined rotation amount, so as to perform a cleaning operation to remove a film deposited on the outer circumferential surface, and (ii) the control unit reduces the rotational speed of the brush motor while not performing the cleaning operation, so as to correct a conveyance distance of the recording sheet.

2. The image forming apparatus of claim 1, further comprising:

a recording unit configured to record therein a rotational speed and a cumulative rotational period of the brush motor after completion of a most recent cleaning operation; and a rotational amount determination unit configured to determine a rotational amount of the brush motor for a next cleaning operation, based on the rotational speed and the cumulative rotational period recorded in the recording unit.

3. The image forming apparatus of claim 1, further comprising:

a deposition amount estimation unit configured to estimate an amount of a film deposited on the outer circumferential surface of the brush motor; and a rotational amount determination unit configured to determine the rotational amount such that the higher the estimated amount of the deposited film, the higher the rotational amount.

4. The image forming apparatus of claim 1, further comprising:

a deposition amount estimation unit configured to estimate an amount of a film deposited on the outer circumferential surface of the brush motor; and a cleaning prohibition unit configured to prohibit the control unit from performing a cleaning operation when the estimated amount of the deposited film is less than a threshold value.

5. The image forming apparatus of claim 1, further comprising an end position recording unit configured to record therein an end position in a cleaning range where a most recent cleaning operation has been performed in a circumferential direction of the commutator, wherein the control unit refers to the end position in the cleaning range recorded in the end position recording unit, so as to start a next cleaning operation from the recorded end position.

6. The image forming apparatus of claim 1, further comprising:

a downstream roller that is provided downstream of the conveyance roller on a conveyance path of recording sheets, and configured to convey recording sheets; and a rotational amount determination unit configured to determine a rotational amount of the brush motor, such that an amount of sag of a recording sheet during a cleaning operation is less than a threshold value, the amount of sag being calculated based on a conveyance distance between the conveyance roller and the downstream roller, a difference in conveyance speed between the conveyance roller and the downstream roller, and the rotational amount.

7. The image forming apparatus of claim 1, further comprising a timing roller configured to adjust a timing of conveying a recording sheet, such that a toner image carried on an intermediate transfer member is transferred onto a predetermined position on the recording sheet, wherein the conveyance roller is part of a plurality of conveyance rollers that are provided upstream of the timing roller on a conveyance path of recording sheets, and while any of the conveyance rollers conveys a recording sheet, the control unit performs a cleaning operation on any of the plurality of brush motors that drive the conveyance rollers to rotate, and reduces a rotational speed of any of the brush motors.

8. The image forming apparatus of claim 7, wherein while any of the conveyance rollers conveys a recording sheet, the control unit performs a cleaning operation on one of the brush motors that drives the any conveyance roller to rotate, and reduces a rotational speed of the one brush motor.

9. The image forming apparatus of claim 1, wherein the conveyance roller is part of a plurality of conveyance rollers that are provided on a conveyance path of recording sheets, and while the conveyance rollers simultaneously convey a recording sheet, the control unit simultaneously performs a cleaning operation on each of respective brush motors that drive the conveyance rollers to rotate.

* * * * *